US011128035B2

(12) United States Patent
Driscoll et al.

(10) Patent No.: US 11,128,035 B2
(45) Date of Patent: Sep. 21, 2021

(54) PHASE-SELECTABLE ANTENNA UNIT AND RELATED ANTENNA, SUBSYSTEM, SYSTEM, AND METHOD

(71) Applicant: Echodyne Corp., Kirkland, WA (US)

(72) Inventors: Tom Driscoll, Bellevue, WA (US); Nathan Ingle Landy, Seattle, WA (US); Robert Tilman Worl, Issaquah, WA (US); Felix D. Yuen, Newcastle, WA (US); Charles A. Renneberg, Seattle, WA (US); Yianni Tzanidis, Springboro, OH (US)

(73) Assignee: Echodyne Corp., Kirkland, WA (US)

( * ) Notice: Subject to any disclaimer, the term of this patent is extended or adjusted under 35 U.S.C. 154(b) by 0 days.

(21) Appl. No.: 16/389,782

(22) Filed: Apr. 19, 2019

(65) Prior Publication Data

US 2020/0335859 A1 Oct. 22, 2020

(51) Int. Cl.

| | |
|---|---|
| ***H01Q 1/38*** | (2006.01) |
| ***H01Q 1/32*** | (2006.01) |
| ***H01Q 3/24*** | (2006.01) |
| ***H01Q 21/00*** | (2006.01) |
| ***H01Q 21/06*** | (2006.01) |

(Continued)

(52) U.S. Cl.

CPC ..... *H01Q 1/38* (2013.01); *H01Q 1/3233* (2013.01); *H01Q 3/247* (2013.01); *H01Q 9/0442* (2013.01); *H01Q 21/0037* (2013.01); *H01Q 21/065* (2013.01); *H01Q 23/00* (2013.01)

(58) Field of Classification Search

None

See application file for complete search history.

(56) References Cited

U.S. PATENT DOCUMENTS

| | | | |
|---|---|---|---|
| 2,981,949 A | 4/1961 | Elliott | |
| 4,870,424 A | 9/1989 | Lalezari et al. | |

(Continued)

FOREIGN PATENT DOCUMENTS

| | | | | |
|---|---|---|---|---|
| GB | 2520920 A | * | 6/2015 | ..... H01Q 3/34 |
| GB | 2520920 A | | 6/2015 | |

(Continued)

OTHER PUBLICATIONS

International Searching Authority, "International Search Report and Written Opinion from PCT Application No. PCT/US2020/028723", from Foreign Counterpart to U.S. Appl. No. 16/389,782, dated Jul. 28, 2020, pp. 1 through 14, Published: WO.

(Continued)

*Primary Examiner* — Ahn Q Tran

(74) *Attorney, Agent, or Firm* — Fogg & Powers LLC

(57) ABSTRACT

In an embodiment, an antenna unit for an antenna array allows shifting the phase of a radiated or received signal without the need for a phase shifter, and includes an antenna element, switching devices, and signal couplers. The antenna element includes at least one section and signal ports each electrically isolated from each other and from each of the at least one section. The switching devices are each configured to couple a respective one of the signal ports to one of the at least one section in response to a respective control signal, and the signal couplers are each configured to couple a respective one of the signal ports to a respective location of a respective transmission medium.

31 Claims, 19 Drawing Sheets

(51) Int. Cl.
*H01Q 23/00* (2006.01)
*H01Q 9/04* (2006.01)

(56) References Cited

U.S. PATENT DOCUMENTS

| | | | |
|---|---|---|---|
| 5,781,157 | A | 7/1998 | Laird |
| 7,081,851 | B1 | 7/2006 | Lewis |
| 9,385,435 | B2 | 7/2016 | Bily et al. |
| 9,450,310 | B2 | 9/2016 | Bily et al. |
| 9,853,361 | B2 | 12/2017 | Chen et al. |
| 2004/0227667 | A1 | 11/2004 | Sievenpiper |
| 2006/0114155 | A1 | 6/2006 | Numminen |
| 2007/0279294 | A1 | 12/2007 | York |
| 2010/0141527 | A1 | 6/2010 | Lalezari |
| 2011/0063158 | A1 | 3/2011 | Kondou |
| 2012/0194399 | A1 | 8/2012 | Bily et al. |
| 2014/0070994 | A1 | 3/2014 | Schmalenberg et al. |
| 2014/0266946 | A1 | 9/2014 | Bily et al. |
| 2015/0109178 | A1 | 4/2015 | Hyde et al. |
| 2015/0214615 | A1 | 7/2015 | Patel et al. |
| 2015/0288063 | A1 | 10/2015 | Johnson et al. |
| 2015/0318618 | A1 | 11/2015 | Chen et al. |
| 2015/0380828 | A1 | 12/2015 | Black et al. |
| 2016/0011307 | A1* | 1/2016 | Casse ..... G01S 13/931 701/93 |
| 2016/0099500 | A1 | 4/2016 | Kundtz et al. |
| 2018/0026365 | A1 | 1/2018 | Driscoll et al. |
| 2018/0040955 | A1 | 2/2018 | Vouvakis et al. |
| 2018/0054004 | A1 | 2/2018 | Driscoll et al. |
| 2018/0372837 | A1 | 12/2018 | Bily et al. |
| 2019/0074600 | A1 | 3/2019 | Bily et al. |
| 2019/0115651 | A1 | 4/2019 | Driscoll et al. |

FOREIGN PATENT DOCUMENTS

| | | | |
|---|---|---|---|
| WO | 2017078184 | A1 | 5/2017 |
| WO | 2019005870 | A1 | 1/2019 |
| WO | 2020241933 | A1 | 10/2020 |

OTHER PUBLICATIONS

U.S. Patent and Trademark Office, "Restriction Requirement", U.S. Appl. No. 16/159,567, filed Jun. 11, 2020, pp. 1 through 6, Published: US.

International Searching Authority, "International Search Report and Written Opinion from PCT Application No. PCT/US2018/039600 dated Oct. 9, 2018", from Foreign Counterpart to U.S. Appl. No. 16/019,371, pp. 1-19, Published: WO.

Huang et al, "Chapter 11, Design and Modeling of Micorstrip Line to Substrate Integrated Waveguide Transitions", "Passive Micowave Components and Antennas", "retrieved on Feb. 5, 2017 from: http://www.intechopen.com/books/passive-microwavecomponents-and-antennas/design-and-modeling-of-microstrip-line-to-substrate-integrated-waveguidetransitions", dated Apr. 1, 2010, pp. 225-246 and reference, Publisher: INTECH.

International Searching Authority, "International Search Report from PCT Application No. PCT/US2017/043110 filed Jul. 20, 2017", "from Foreign Counterpart of U.S. Appl. No. 15/655,505", dated Nov. 2, 2017, pp. 1-15, Published in WO.

International Searching Authority, International Search Report and Written Opinion from PCT Application No. PCT/US2017/046943 dated Oct. 26, 2017, From PCT Counterpart of U.S. Appl. No. 15/240,980, pp. 1-20, WO.

Harter et al., "Realization of an Innovative 3D Imaging Digital Beamforming Radar System", 2011, pp. 1-4, IEEE.

International Searching Authority, "International Search Report and Written Opinion from PCT Application No. PCT/US2018/055737 dated Apr. 18, 2019", from Foreign Counterpart to U.S. Appl. No. 16/159,567, pp. 1-25 Published: WO.

International Searching Authority, "Invitation to Pay Additional Fees from PCT Application No. PCT/US2018/055737 mailed Jan. 31, 2019", from Foreign Counterpart to U.S. Appl. No. 16/159,567, pp. 1-21, Published: WO.

Martinez et al., "High-Efficiency FET/Microstrip-Patch Oscillators", IEEE Antennas and Propagation Magazine, Feb. 1994, pp. 16-19, vol. 36, No. 1, IEEE.

Park et al., "A Slotted Post-Wall Waveguide Array With Interdigital Structure for 45° Linear and Dual Polarization", IEEE Transaction on Antennas and Propagation, Sep. 2005, pp. 2865-2871, vol. 53, No. 9, IEEE.

International Bureau, "International Preliminary Report on Patentability from PCT Application No. PCT/US2018/055737", from Foreign Counterpart to U.S. Appl. No. 16/159,567, dated Apr. 23, 2020, pp. 1 through 17, Published: WO.

U.S. Patent and Trademark Office, "Office Action", U.S. Appl. No. 16/159,567, dated Oct. 16, 2020, pp. 1 through 47, Published: US.

* cited by examiner

PHASE-SELECTABLE ANTENNA UNIT AND RELATED ANTENNA, SUBSYSTEM, SYSTEM, AND METHOD

CROSS-REFERENCE TO RELATED APPLICATION

This application is related to U.S. patent application Ser. No. 16/159,567, filed Oct. 12, 2018, and titled "BEAM-STEERING ANTENNA," which claims priority from U.S. Provisional Patent Application No. 62/572,043, filed Oct. 13, 2017, the content of the related applications is incorporated herein by reference.

SUMMARY

A phased-array antenna, or phased array, is configured to steer one or more narrow, electromagnetic-signal beams over a prescribed region of space by shifting the phase of a reference signal by a respective amount at each of a multitude of radiating antenna elements. Typically, a phased array includes, for each antenna element, a respective phase-shift circuit, or phase shifter, to perform such phase shifting.

Unfortunately, although it typically offers unparalleled beam-steering performance and agility, a phased array typically suffers from significant cost, size, weight, and power (C-SWAP) limitations due, in large part, to the phase shifters. For example, although a low-loss phase shifter can maintain an antenna's power consumption at an acceptable level for a given application, such a phase shifter is typically bulky (i.e., large and heavy) and expensive. And although a reduced-size phase shifter can meet the cost, size, and weight specifications for a given application, such a phase shifter typically exhibits high signal loss, and, therefore, typically requires a corresponding power amplifier at the phase shifter's input node or output node; the inclusion of one power amplifier per phase shifter not only can cause the power consumption of the phased array to exceed a specified level, but also can offset, at least partially, the reductions in cost, size, and weight that the low-loss phase shifter provides.

An embodiment of an antenna array that solves one or more of the above problems with a phased array is configured to adjust the phase of a respective signal radiated or received by each antenna element without a conventional phase shifter. Therefore, an embodiment of such an antenna array can have significantly lower C-SWAP metrics while retaining the higher performance metrics of a phased array.

An embodiment an antenna unit of such an antenna array includes an antenna element, switching devices, and signal couplers. The antenna element includes at least one section and signal ports each electrically isolated from each other and from each of the at least one section. The switching devices are each configured to couple a respective one of the signal ports to one of the at least one section in response to a respective control signal, and the signal couplers are each configured to couple a respective one of the signal ports to a respective location of a respective transmission medium.

During a transmit mode, by tapping a transmit version of a reference wave from a selectable one of multiple different locations of a transmission medium, and by exciting a corresponding excitation point of the antenna element with the tapped reference wave, such an antenna unit can allow selection of the phase of the signal that excites the antenna element, and, therefore, can allow selection of the phase of the signal that the antenna element radiates. And the antenna unit can include a phase tuner, such as a tunable reactance, to allow even finer control of the phase of the radiated signal.

Similarly, during a receive mode, by exciting an antenna element with a received signal, and by coupling the received signal from a selectable one of multiple different receive points of the antenna element to a corresponding one of multiple different locations of a transmission medium, such an antenna unit can allow selection of the phase of the signal that the antenna element generates and in response to which the transmission medium generates a receive version of the reference wave. And the antenna unit can include a phase tuner, such as a tunable reactance, to allow even finer control of the phase of the signal in response to which the transmission medium generates the receive version of the reference wave.

By allowing selection of signal phase during transmit and receive modes, an embodiment of an antenna unit can omit a conventional phase shifter yet still can be configured such that an antenna including the antenna unit can have a minimum lattice spacing $d_1$ that approaches the theoretical maximum practical spacing of $\lambda/2$ (at least in one dimension of an antenna array, such as the azimuth dimension), where $\lambda$ is the wavelength of the reference wave in the medium in which an antenna including the antenna unit is configured to radiate. For example, if an antenna is configured to radiate in air, then the wavelength can be approximated as the free-space wavelength Ao because each of the magnetic permeability and the electric permittivity of air are approximately equal to the permeability and permittivity of a vacuum, respectively.

Furthermore, an antenna that includes an embodiment of antenna unit such as described above may be better suited for some applications than a conventional phased array. For example, a phased array of a traditional radar system may be too dense and may scan a field of view (FOV) too slowly, and the radar system may be too expensive, for use in an autonomous (self-driving) automobile. Similarly, a phased array of a traditional radar system may be too dense, and the radar system may be too expensive, too heavy, and too power hungry, for use in an unmanned aerial vehicle (UAV) such as a drone.

DETAILED DESCRIPTION

The words "approximately" and "substantially" may be used below to indicate that two or more quantities can be exactly equal, or can be within ±10% of each other due to, for example, manufacturing tolerances, or other design considerations, of the physical structures described below.

Figure 1:
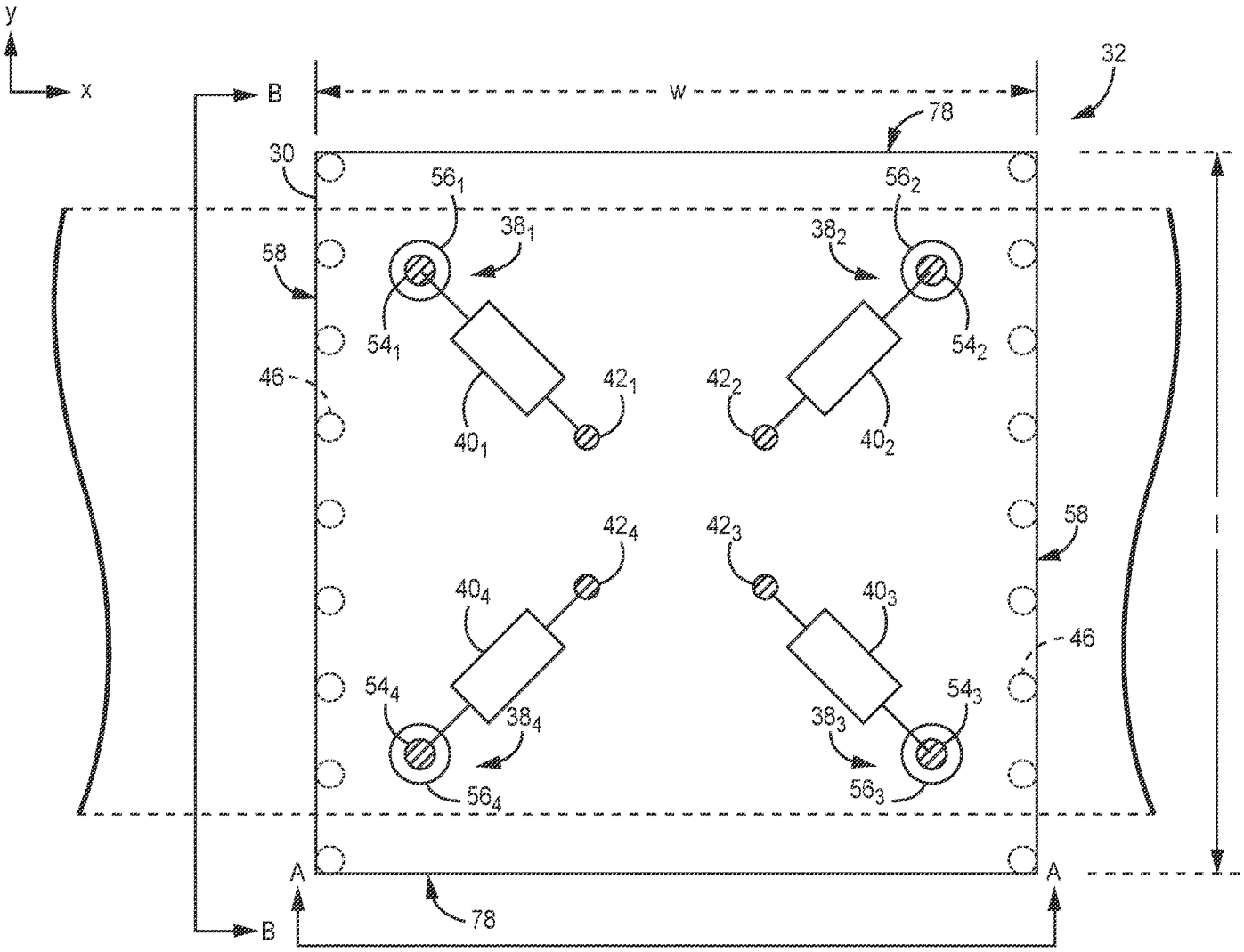
FIG. 1 is a plan view of an antenna unit of an antenna array, according to an embodiment.

FIG. 1 is a plan view of an antenna element 30 of an antenna unit 32, according to an embodiment.

Figure 2:
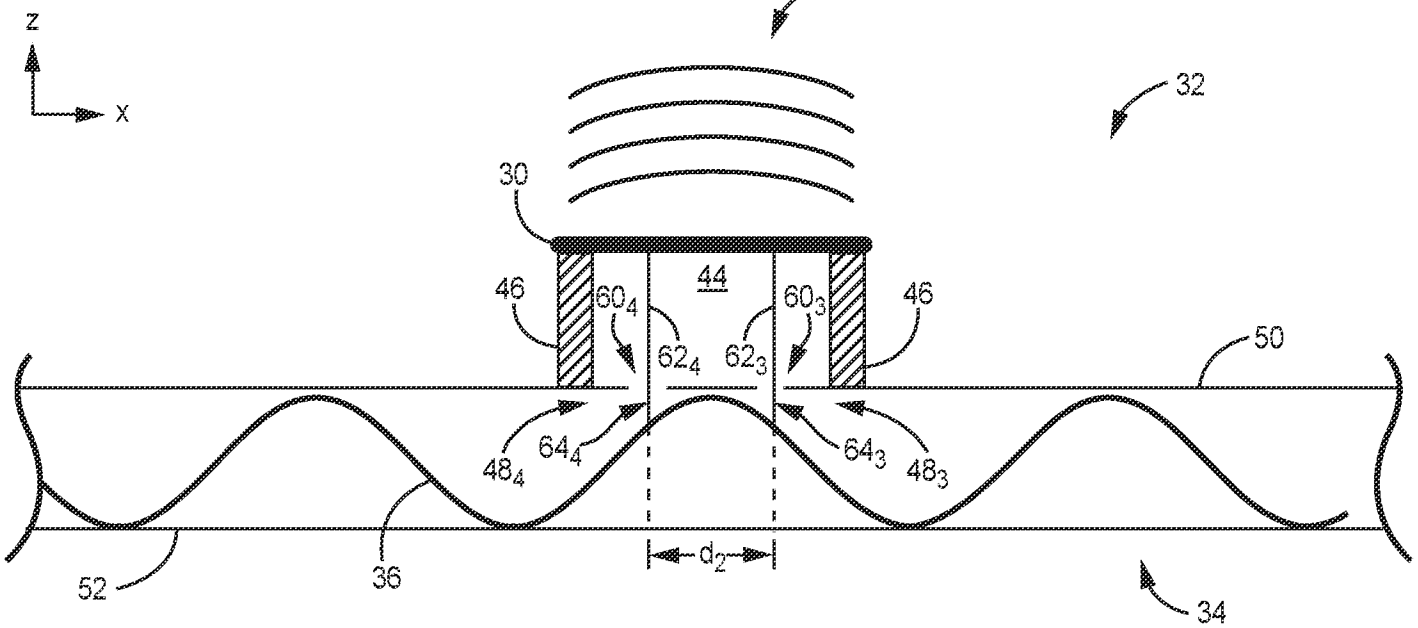
FIG. 2 is cutaway side view of the antenna unit of FIG. 1 and of a transmission medium, according to an embodiment.

FIG. 2 is a side view of the antenna unit 32 taken along lines A-A of FIG. 1, and of a transmission medium 34 at least partially disposed beneath the antenna unit, according to an embodiment.

Referring to FIGS. 1-2 and as further described below, the antenna unit 32 is configured to allow selection of a phase of a transmit signal radiated by the antenna element 32, and to allow selection of a phase of a signal that the antenna element generates in response to a receive signal received by the antenna element.

Consequently, if included as part of an antenna array (hereinafter "antenna" or "antenna array"), an embodiment of the antenna unit 32 can provide the antenna with:

a. performance metrics (e.g., beam-steering resolution), antenna-element spacing, and component density that are on par, respectively, with the performance metrics, antenna-element spacing, and component density of a phased array, and b. C-SWAP metrics that are significantly lower, i.e., significantly improved, as compared with the C-SWAP metrics of a phased array.

That is, an embodiment of the antenna unit 32 can impart to the antenna one or more of the best features of a phased array and mitigate one or more of the worst features of a phased array. For example, such an antenna may have a lattice spacing $d_1$, which approaches $\lambda_0/2$ (e.g., $d_1 \approx 0.4\lambda_0$), and where $\lambda_0$ is a wavelength of a reference wave 36 that the transmission medium 34 is configured to carry, and, therefore, is a wavelength of signals that the antenna is configured to transmit and to receive, in the medium, here air, in which the antenna is configured to radiate. And the lattice spacing $d_1$ is the spacing between immediately adjacent antenna elements 30 measured from a location (e.g., rightmost edge) of one the antenna elements to the same relative location (e.g., rightmost edge) of the other of the antenna elements.

Still referring to FIGS. 1-2, in addition to the antenna element 30, the antenna unit 32 includes signal ports $\mathbf{38}_1$-$\mathbf{38}_4$, antenna-unit-activation-and-phase-selection devices $\mathbf{40}_1$-$\mathbf{40}_4$, excitation points $\mathbf{42}_1$-$\mathbf{42}_4$, an intermediate region 44 between the antenna element 30 and the transmission medium 34, reference vias 46, and signal couplers $\mathbf{48}_1$-$\mathbf{48}_4$ (only couplers $\mathbf{48}_3$-$\mathbf{48}_4$ visible in FIG. 2). As described below, the signal ports $\mathbf{38}_1$-$\mathbf{38}_4$ correspond to different signal phases of signals that the antenna element 30 is configured to transmit and to receive, the different signal phases being separated by 360°/(number of signal ports)=360°/(4)=90°. That is, the signal ports $\mathbf{38}_1$-$\mathbf{38}_4$ respectively correspond to the following relative phases of the signals that the antenna element 30 is configured to transmit and to receive: 0°, 90°, 270°, and 180°.

The antenna element 30 is conductive patch antenna element, which is, ideally, a planar conductor having a width w in a dimension x of propagation of the reference wave 36, and having a length $l\lambda_m/2$ in a dimension y orthogonal to the dimension of propagation of the reference wave, where $\lambda_m$ is the wavelength of the reference wave in the intermediate region 44. A designer can set the width w to impart, to the antenna unit 32, particular characteristics such as impedance at a particular excitation point 42. But the width w is typically other than an integer multiple of/to prevent the antenna element 30 from radiating and receiving along edges of the antenna element that lie in the y dimension.

The transmission medium 34 can be any type of a suitable transmission medium, such as a microstrip or a waveguide. In an embodiment, the transmission medium 34 includes an upper conductive boundary 50 and a lower conductive boundary 52, which are, ideally, planar. The transmission medium 34 is further described below in conjunction with FIGS. 4-7.

The reference wave 36 is typically a sinusoid, and has two versions. A transmit version during a transmit mode of an antenna that includes the antenna unit 32, and a receive version during a receive mode of the antenna. The reference wave 36 is further described below in conjunction with FIGS. 4-7.

The signal ports $\mathbf{38}_1$-$\mathbf{38}_4$ each include a respective inner conductor $\mathbf{54}_1$-$\mathbf{54}_4$ and a respective insulator region $\mathbf{56}_1$-$\mathbf{56}_4$, which is configured to electrically isolate the respective inner conductor from the conductive antenna element 30.

The activation devices $\mathbf{40}_1$-$\mathbf{40}_4$ are electronically controllable impedances, or switching devices, which are each coupled between a respective inner conductor 54 and a respective excitation point 42; examples of the activation devices include PIN or other types of diodes, and other semiconductor devices such as transistors. For example, if each of one or more of the activation devices $\mathbf{40}_1$-$\mathbf{40}_4$ is a respective PIN diode, then the anode of each diode is coupled to a respective inner conductor 54, and the cathode of each diode is coupled to a respective excitation point 42. Furthermore, each PIN-diode activation device 40 is configured to receive, via the respective inner conductor 54, a respective DC bias voltage; that is, the inner conductor acts as a control node for coupling or uncoupling the corresponding signal port 38 from the corresponding excitation point 42. In response to a positive DC bias voltage (e.g., +3.0 Volts (V)) on the inner conductor 54, the PIN-diode activation device 40 is forward biased and, therefore, presents an inductive, coupling, impedance, which effectively electrically couples the respective signal port 38 to the respective excitation point 42, at least at the frequency of the reference wave 36; conversely, in response to a negative DC bias voltage (e.g., −3.0 V) on the inner conductor 54, the PIN-diode activation device 40 is reverse biased and, therefore, presents a capacitive, blocking, impedance, which effectively uncouples the respective signal port from the respective excitation point at least at the frequency of the reference wave. For example, biasing the PIN-diode activation device $\mathbf{40}_1$ with a positive DC bias voltage of +3.0 V, and biasing the remaining PIN-diode activation devices $\mathbf{40}_2$-$\mathbf{40}_4$ with negative DC bias voltages of −3.0 V, couples the signal port $\mathbf{38}_1$ to the antenna element 30 and uncouples the remaining signal ports $\mathbf{38}_2$-$\mathbf{38}_4$ from the antenna element. The antenna unit 32 can include a circuit structure configured to couple a control/bias voltage to an inner conductor 54 by superimposing the control/bias voltage onto the portion of the reference wave 36 coupled to the inner conductor, and configured to uncouple the reference wave from the circuit that generates the control/bias voltage. An embodiment of such a circuit structure is described below in conjunction with FIGS. 15-18. Furthermore, while it is positively (forward) biased, a PIN-diode activation device 40 conducts a DC bias current from the DC bias circuitry (not shown in FIGS. 1-2); therefore, although designing the antenna unit 32 such that a negative DC bias voltage corresponds to a signal-coupling state of a PIN-diode activation device, designing the antenna unit such that a positive DC bias voltage corresponds to a signal-coupling state of a PIN-diode activation device reduces the load on the DC bias circuitry because no more than one PIN-diode activation device per antenna element 30 is conducting a bias current at any given time. Moreover, the distances between the signal ports 38 and the excitation points 42 are not necessarily drawn to scale. For example, if an activation device 40 is a surface-mount device such as a surface-mount diode, then the distance between the corresponding inner conductor 54 and the corresponding excitation point 42 can be electrically small, for example, on the order of approximately $\lambda_m/50$, where $\lambda_m$ is the wavelength of the traveling reference wave 36 in the intermediate region 44.

Each excitation point $\mathbf{42}_1$-$\mathbf{42}_4$ is a respective location of the antenna element 30 at which a signal from the corresponding one of the signal ports $\mathbf{38}_1$-$\mathbf{38}_4$ drives, i.e., excites, the antenna element during a transmit mode (while the corresponding one of the activation devices $\mathbf{40}_1$-$\mathbf{40}_4$ is active), and at which a signal received by the antenna element drives, i.e., excites, the corresponding signal port during a receive mode (while the corresponding activation device is active). Each excitation point 42 can be located at any suitable respective location of the antenna element 30. For example, the location of each excitation point 42 can be selected so that the corresponding signal port 38, while selected, "sees" an antenna-element impedance that allows the antenna element 30 to operate in a resonant, or near-resonant, mode, and the impedances of each of a corresponding signal port, activation device, and excitation point can be matched to reduce or eliminate signal reflections.

The intermediate region 44 is located between the antenna element 30 and the conductive upper boundary 50 of the transmission medium 34, and can be formed from any suitable material such as a dielectric material.

The conductive reference vias 46 couple y-dimension edges 58 (the non-radiating edges as described below in conjunction with FIG. 3) of the antenna element 30 to the conductive upper boundary 50 of the transmission medium 34 so that there is approximately 0 Volts (V) DC between the antenna element and the upper conductive boundary. And if the conductive upper boundary 50 is coupled to a reference voltage such as ground (i.e., 0 V DC), then the vias 46 are configured to couple the antenna element to the same reference voltage via the conductive upper boundary. Furthermore, the pitch of the vias 46 is sufficiently small (i.e., the spacing between immediately adjacent vias $<<\mu_m$) such that the vias are configured to isolate, electrically, the antenna unit 32 from adjacent antenna units in the x dimension. Such electrical isolation, sometimes called Faraday-cage isolation, is configured to reduce the magnitudes of, or to eliminate, unwanted electromagnetic modes in which the antenna unit 32 might otherwise operate.

The signal couplers $\mathbf{48}_1$-$\mathbf{48}_4$ (only the couplers $\mathbf{48}_3$ and $\mathbf{48}_4$ are visible in FIG. 2) each include a respective iris 60 and a respective probe 62. Each iris $\mathbf{60}_1$-$\mathbf{60}_4$ is a respective opening in the conductive upper boundary 50 of the transmission medium 34, and can have any suitable size; for example, the size of an iris can be selected so that the iris, or the combination of the iris and corresponding probe 62, has a particular impedance at the frequency of the reference wave 36. Each probe 62 is a conductive member, such as a wire, that extends from a respective location 64 within the transmission medium 34, through a corresponding iris 60, through the intermediate region 44, and to an inner conductor 54 of a corresponding signal port 38; alternatively, the inner conductor and the probe can be one in the same structure. Furthermore, due to manufacturing constraints, each of one or more of the probes 62 may extend all the way to, and even into, the conductive lower boundary 52 of the transmission medium 34. In such an embodiment, there may be formed, in the conductive lower boundary, a respective opening aligned with each so-extending probe so that the probe does not contact the conductive lower boundary because such contact can degrade the probe's ability to couple the reference wave 36 to the respective port 38. And, each of one or more of the probes 62 may not contact a respective inner conductor 54, but instead, there may be, between the probe and the inner conductor, a space that is configured to capacitively couple the probe to the inner conductor. In such an embodiment, a designer designs the antenna unit 32 such that the capacitance of this space, together with the inductive impedances of the corresponding inner conductor 54 and the activation device 40 while biased in a coupling state, form a series-resonant circuit such that while the activation device is biased in a coupling state, there is, at least theoretically, an impedance of zero between the probe 62 and the corresponding excitation point 42 at the frequency of the reference wave 36. Alternatively, a designer can design the antenna unit 32 such that the impedance between the probe 62 and the corresponding excitation point 42, while the corresponding activation device 40 is biased in a coupling state, approximately matches the impedance of the antenna element 30 at the corresponding excitation point 42 to limit or eliminate signal reflections.

The probe $\mathbf{62}_3$ and the probe $\mathbf{62}_4$ and, therefore, the locations $\mathbf{64}_3$ and $\mathbf{64}_4$, are spaced apart by a distance $d_2 \approx \lambda_m/4$ such that the phase difference between the reference wave 36 at the probe $\mathbf{62}_3$ and the reference wave at the probe $\mathbf{62}_4$ is approximately 90°; that is, the electrical path between the probes $\mathbf{62}_3$ and $\mathbf{62}_4$ has a length that is equivalent to approximately $\lambda_m/4$. Said another way, due to parasitic effects (e.g., one or more parasitic impedances), the actual distance $d_2$ that yields a reference-wave phase difference of 90° between the probes $\mathbf{62}_3$ and $\mathbf{62}_4$ can differ from $\lambda_m/4$ by up to 30% of $A_m/4$ or more. Similarly, the probe $\mathbf{62}_1$ and the probe $\mathbf{62}_2$ (not visible in FIG. 2) and, therefore, the locations $\mathbf{64}_1$ and $\mathbf{64}_2$ (also not visible in FIG. 2) are spaced apart by a distance $d_2 \approx \lambda_m/4$ such that the phase difference between the reference wave 36 at the probe $\mathbf{62}_1$ and the reference wave at the probe $\mathbf{62}_2$ is approximately 90°; that is, the electrical path between the probes $\mathbf{62}_3$ and $\mathbf{62}_4$ has a length that is equivalent to approximately $\lambda_m/4$ taking into account parasitic affects, where "approximately" in this instance means up to 30% of $\lambda_m/4$ or more. And, as described below, due to the radiation properties of the antenna element 30, the phase difference between the probes $\mathbf{62}_1$ and $\mathbf{62}_4$ is approximately 180°, as is the phase difference between the probes $\mathbf{62}_2$ and $\mathbf{62}_3$. These phase differences yield the relative phases of 0°, 90°, 270°, and 180° at the signal ports $\mathbf{38}_1$-$\mathbf{38}_4$ as described above.

Figure 3:
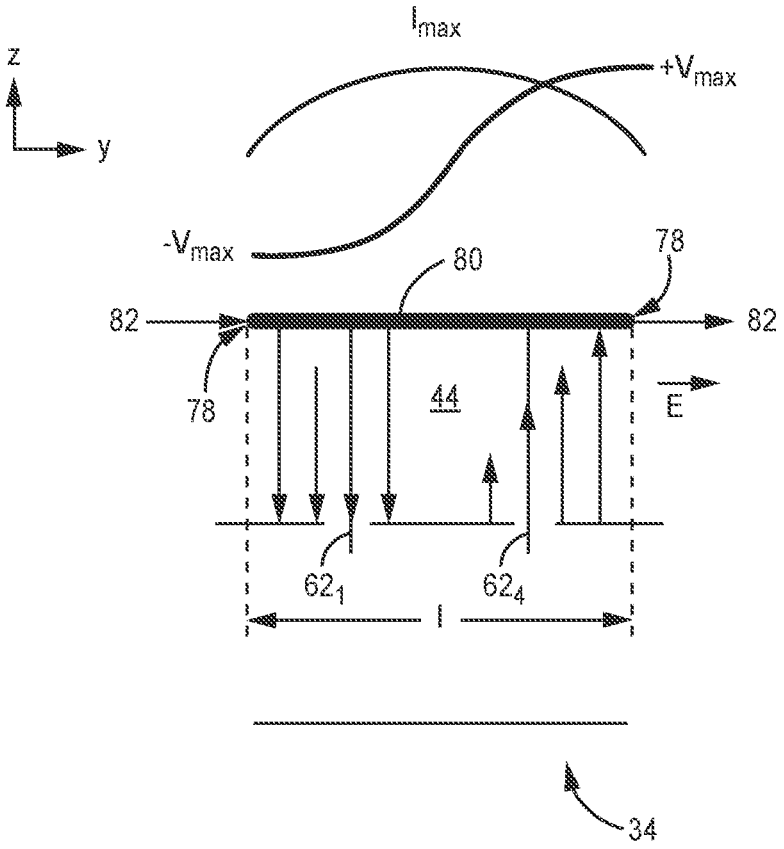
FIG. 3 is a diagram of the antenna unit and the transmission medium of FIG. 2, and includes a plot of an electric field generated between the transmission medium and an antenna element of the antenna unit, according to an embodiment.

FIG. 3 is a cutaway side view of the antenna unit 32 and the transmission medium 34 taken along lines B-B of FIG. 1, and includes, overlaying the antenna unit, plots of the current I, the voltage V, and the electric-field $\vec{E}$ generated by the antenna unit, according to an embodiment. Although the current I, voltage V, and electric field $\vec{E}$ are described for a transmit mode during which the antenna element 30 is radiating a signal 76 (FIG. 2), the current I, voltage V, and electric field $\vec{E}$ are respectively similar for a receive mode during which the antenna element is receiving a signal from a remote location and feeding the signal to the transmission medium 34 via a selected one of the signal ports $\mathbf{38}_1$-$\mathbf{38}_4$ (FIG. 1).

As described above, the length l of the antenna element 30 in the y dimension is set to approximately $\lambda_m/2$ so that the antenna element operates in a resonant mode (l may not be set exactly to $\lambda_m/2$ so that the real part of the impedance of the antenna element has a minimum, or another particular, value that may facilitate resonant-mode operation).

Figure 4:
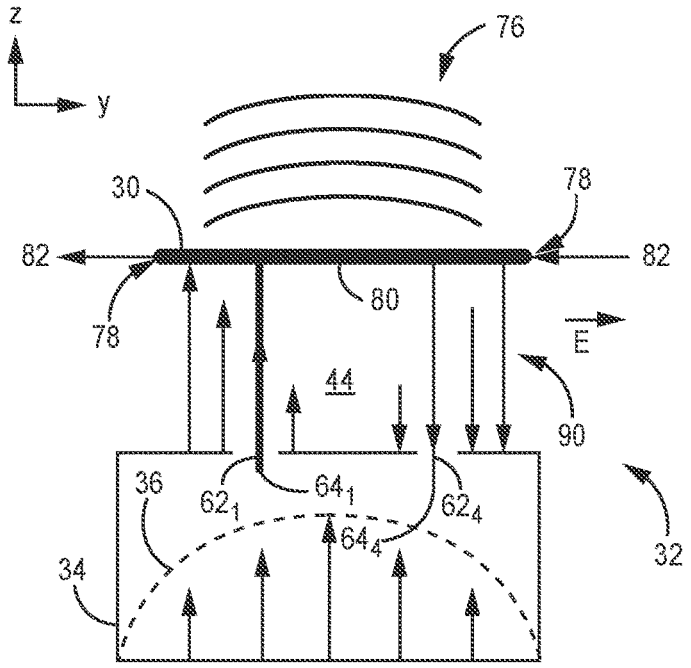
FIG. 4 is diagram of the antenna unit of FIG. 3, and includes a plot of an electric field between the transmission medium and the antenna element for a corresponding selected signal-coupling location, according to an embodiment in which the transmission medium is a waveguide.
Figure 5:
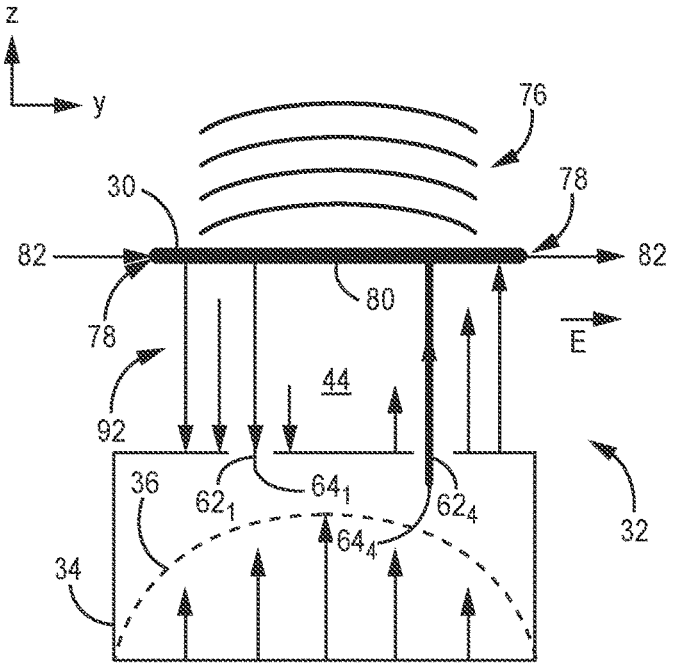
FIG. 5 is diagram of the antenna unit of FIGS. 3-4, and includes a plot of an electric field between the transmission medium and the antenna element for a corresponding other selected signal-coupling location, according to an embodiment in which the transmission medium is a waveguide.

During a resonant transmit mode, the antenna element 30 is excited with a signal from one of the signal ports 38, and, in response to this excitation signal, generates a current I that is zero at the radiating ends 78 of the antenna elements and that fluctuates between $\pm I_{max}$ at a center line 80 of the antenna element, the center line extending in the x dimension (into and out of the page of FIG. 5). If the reference wave 36 (FIG. 4) is sinusoidal, then the current I is a half sinusoid having, at the center line 80, an amplitude that fluctuates sinusoidally between $+I_{max}$ and $-I_{max}$.

Further in response to the excitation signal, the antenna element 30 generates, between it and the conductive upper boundary 50 of the transmission medium 34, a voltage V that is zero at the center line 80 and that fluctuates between $\pm V_{max}$ at the radiating ends 78 of the antenna element. Furthermore, the voltage V at any point on one side of the center line 80 is 180° out of phase with the voltage V at a symmetrically corresponding point on the other side of the center line. If the reference wave 36 (FIG. 4) is sinusoidal, then the voltage V is a half sinusoid having, at the edges 78, respective amplitudes that fluctuate sinusoidally between $+V_{max}$ and $-V_{max}$, and between $-V_{max}$ and $+V_{max}$, respectively. And because the electric field $\vec{E}$ is in units of Volts per meter (Vim), the magnitude of $\vec{E}$ follows the magnitude of the voltage V.

Because the current I flowing in the antenna element 30 is effectively cancelled by a current of an equal magnitude and opposite polarity (i.e., 180° out of phase) flowing beneath the antenna element in the conductive upper boundary 50, the current I does not induce the signal 76 (FIG. 2) that the antenna element radiates.

Furthermore, because the voltage V is confined to the intermediate region 44 between the antenna element 30 and the boundary 50, the voltage V also does not induce the signal 76 that the antenna element radiates.

But, the electric field $\vec{E}$ has one or more fringe components 82 that radiate from the antenna-element edges 78 in the y dimension. Because the components 82 of that the two edges 78 generate are in phase, these components add constructively; therefore, it is these constructively adding fringe components of $\vec{E}$ that form the signal 76 (FIG. 2) that the antenna element 30 radiates.

FIGS. 4-5 are cutaway side views of the antenna unit 32 and the transmission medium 34 taken along lines B-B of FIG. 1, and include, overlaying the antenna unit, plots 90 and 92 of electric fields $\vec{E}$, which respectively correspond to the signal probe $\mathbf{62}_1$ being active and the signal probe $\mathbf{62}_4$ being active, according to an embodiment in which the transmission medium is a waveguide that supports only a $TE_{10}$ mode of propagation at the frequency and wavelength of the reference wave 36.

Because the reference wave 36 propagates along the transmission medium 34 in only a $TE_{10}$ mode, the phase and amplitude of the reference wave are the same at any two points, such as $\mathbf{64}_1$ and $\mathbf{64}_4$, that are in a same y-z plane on opposite sides of, and equidistant from, the center line 80.

Therefore, referring to FIG. 4, in response to activating the probe $\mathbf{62}_1$ to couple the reference wave 36 at the location $\mathbf{64}_1$ to the antenna element 30 via the signal port $\mathbf{38}_1$ (FIG. 1), as shown by the plot 90, the electric field $\vec{E}$ has a polarity defined by the polarity of the reference wave at the location $\mathbf{64}_1$.

And, as described above in conjunction with FIG. 3, in the intermediate region 44 on the other side of the center line 80 from the active probe $\mathbf{62}_1$, for example, at the probe $\mathbf{62}_4$, as shown by the plot 90, the electric field $\vec{E}$ has an opposite polarity.

Consequently, the phase difference between the probes $\mathbf{62}_1$ and $\mathbf{62}_4$, and, therefore, between the signal ports $\mathbf{38}_1$ and $\mathbf{38}_4$ (FIG. 1) is 180° as described above in conjunction with FIG. 1.

Similarly, referring to FIG. 5, in response to activating the probe $\mathbf{62}_4$ to couple the reference wave 36 at the location $\mathbf{64}_4$ to the antenna element 30 via the signal port $\mathbf{38}_4$, the electric field $\vec{E}$, as shown by the plot 92, has a polarity defined by the polarity of the reference wave 36 at the location $\mathbf{64}_4$.

But because the amplitude and the polarity of the reference wave 36 at the location $\mathbf{64}_4$ are the same as the amplitude and the polarity, respectively, of the reference wave at the location $\mathbf{64}_1$, the phase of $\vec{E}$, as shown by the plot 92, on the right side of the center line 80 is now the same as the phase that $\vec{E}$ had on the left side of the center line while the probe $\mathbf{62}_1$ was active (see the left side of the plot 90 of FIG. 4), and the phase of $\vec{E}$ on the left side of the center line is now the same as the phase that $\vec{E}$ had on the right side of the center line while the probe $\mathbf{62}_1$ was active (see the right side of the plot 90 of FIG. 4).

Consequently, switching between an active probe $\mathbf{62}_1$ and an active probe $\mathbf{62}_4$ shifts, by 180°, the phase of the $\vec{E}$ components 82, and, therefore, the phase of the signal 76 (FIG. 2), that the antenna element 30 radiates.

A similar analysis shows that switching between an active probe $\mathbf{62}_2$ (not visible in FIGS. 4-5) and an active probe $\mathbf{62}_3$ (not visible in FIGS. 4-5) also shifts the phase of the signal 76 (FIG. 2) by 180°.

Therefore, these analyses further support that the signal ports $\mathbf{38}_1$-$\mathbf{38}_4$ respectively correspond to the relative phases 0°, 90°, 270°, and 180° of the radiated signal 76 as described above in conjunction with FIG. 1.

Figure 6:
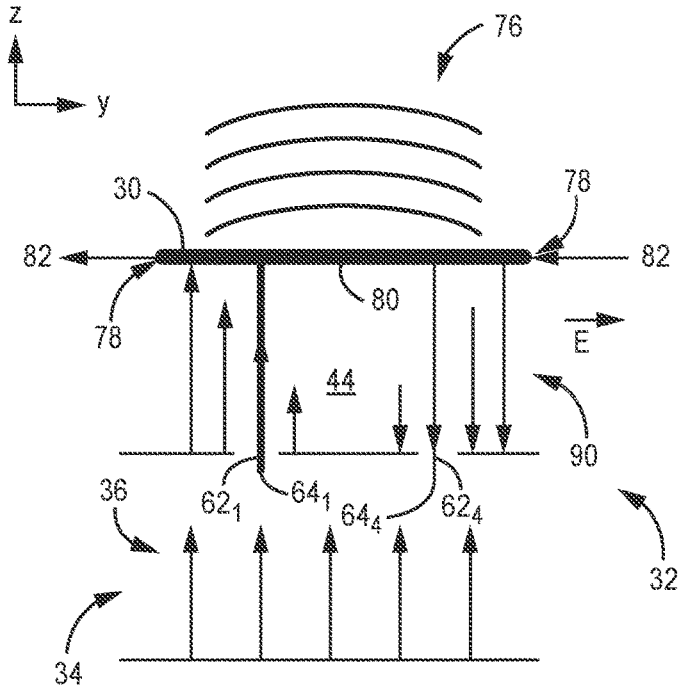
FIG. 6 is diagram of the antenna unit of FIG. 3, and includes a plot of an electric field between the transmission medium and the antenna element for a corresponding selected signal-coupling location, according to an embodiment in which the transmission medium is a micro strip.
Figure 7:
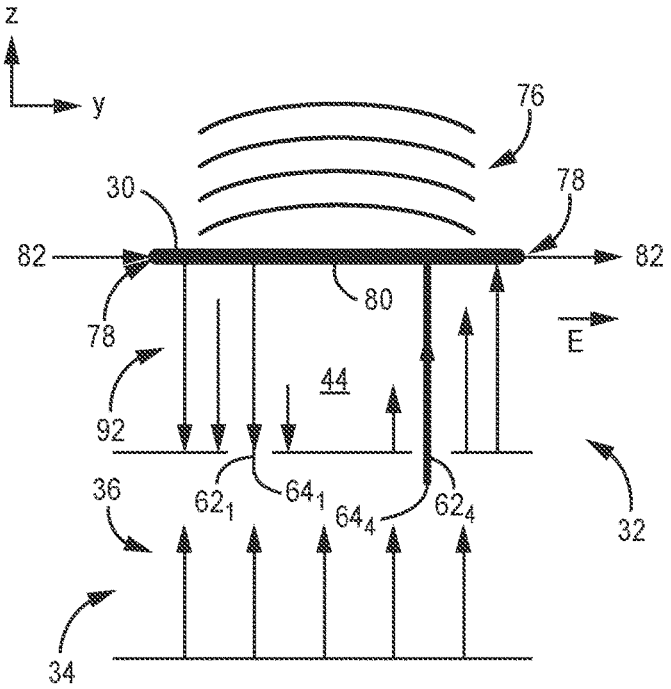
FIG. 7 is diagram of the antenna unit of FIGS. 3 and 6, and includes a plot of an electric field between the transmission medium and the antenna element for a corresponding other selected signal-coupling location, according to an embodiment in which the transmission medium is a micro strip.

FIGS. 6-7 are cutaway side views of the antenna unit 32 and the transmission medium 34 taken along lines B-B of FIG. 1, and include, overlaying the antenna unit, plots 90 and 92 of the electric field $\vec{E}$, which plots respectively correspond to the signal probe $\mathbf{62}_1$ being active and the signal probe $\mathbf{62}_4$ being active, according to an embodiment in which the transmission medium is a microstrip in which the reference wave 36 has a constant amplitude and constant phase in the y dimension.

An analysis similar to the analysis detailed above in conjunction with FIGS. 4-5 shows that the even if the transmission medium 34 is a microstrip, the signal ports $\mathbf{38}_1$-$\mathbf{38}_4$ respectively correspond to the relative phases 0°, 90°, 270°, and 180° of the radiated signal 76 as described above in conjunction with FIG. 1.

Referring to FIGS. 1-7, operation of the antenna unit 32 is described during a transmit mode of an antenna to which the antenna unit belongs, according to an embodiment. For example, if the antenna is part of a radar subsystem, then the antenna generates one or more main radar beams.

A control circuit (not shown in FIGS. 1-7) controls a signal generator (not shown in FIGS. 1-7) to generate a transmit version of the reference wave 36 as a sinusoid having a suitable frequency f and wavelength λ. For example, for a radar application, the transmit version of the reference wave 36 may have a frequency in an approximate range of 5 Gigahertz (GHz)-110 GHz.

Next, the control circuit (not shown in FIGS. 1-7) determines whether to activate or deactivate the antenna unit 32. For example, the control circuit bases this determination on whether the antenna unit 32 is to be active or inactive for the beam pattern that the control circuit is programmed, or otherwise controlled, to generate.

If the control circuit (not shown in FIGS. 1-7) determines that the antenna unit 32 is to be inactive, then it generates, on each of the inner conductors $\mathbf{56}_1$-$\mathbf{56}_4$ of the signal ports $\mathbf{38}_1$-$\mathbf{38}_4$, a respective control voltage (e.g., a DC-bias control voltage) that causes the activation devices $\mathbf{40}_1$-$\mathbf{40}_4$ to uncouple the inner conductors from the respective excitation points $\mathbf{42}_1$-$\mathbf{42}_4$ such that all of the inner conductors are uncoupled from all of the excitation points.

But if the control circuit (not shown in FIGS. 1-7) determines that the antenna unit 32 is to be active, then it determines which of the relative phases 0°, 90°, 270°, and 180° to impart to the signal 76 to be radiated by the antenna element 30.

Next, the control circuit (not shown in FIGS. 1-7) activates the diode 40 associated with the relative phase that the control circuit determined to impart to the signal 76, and deactivates the other diodes. For example, if the control circuit determined to impart the relative phase 270° to the signal 76, then the control circuit generates, on the inner conductor $\mathbf{54}_3$, a control signal (e.g., a DC-bias control voltage) having a value that activates the activation device (e.g., PIN diode) $\mathbf{40}_3$ to couple the inner conductor $\mathbf{54}_3$ to the excitation point $\mathbf{42}_3$, and generates, on the inner conductors $\mathbf{54}_1$, $\mathbf{54}_2$, and $\mathbf{54}_4$, respective control signals having values that deactivate these activation devices to uncouple the inner conductors $\mathbf{54}_1$, $\mathbf{54}_2$, and $\mathbf{54}_4$ from the excitation points $\mathbf{42}_1$, $\mathbf{42}_2$, and $\mathbf{42}_4$, respectively.

Then, the probe 62 associated with the activated activation device 40 couples the transmit version of the reference wave 36 at the respective location 64 to the associated excitation point 42 via the activated activation device to excite the antenna element 30. For example, if the control circuit (not shown in FIGS. 4-7) determined to impart the relative phase 270° to the signal 76, then the probe $\mathbf{62}_3$ couples the transmit version of the reference wave 36 at the location $\mathbf{64}_3$ to the excitation point $\mathbf{42}_3$ via the activated diode $\mathbf{40}_3$.

Next, the excited antenna element 30 radiates, in response to the signal at the excitation point 42 associated with the activated activation device 40, the signal 76 having the relative phase associated with the excitation point. For example, if the control circuit (not shown in FIGS. 4-7) activates the activation device $\mathbf{40}_3$, then the antenna element 30 radiates the signal 76 having a relative phase of 270°.

The control circuit (not shown in FIGS. 1-7) repeats the above steps for one or more subsequent antenna-transmit radiation patterns. For example, the control circuit may repeat the above procedure to step an antenna that includes the antenna unit 32 through a time sequence of transmit radiation patterns to steer each of one or more main transmit beams from a respective one direction to a respective other direction.

Still referring to FIGS. 1-7, operation of the antenna unit 32 is described during a receive mode of an antenna to which the antenna unit belongs, according to an embodiment. For example, if the antenna is part of a radar subsystem, then the antenna generates one or more main radar receive beams.

A control circuit (not shown in FIGS. 1-7) determines whether to activate or deactivate the antenna unit 32. For example, the control circuit bases this determination on whether the antenna unit 32 is to be active or inactive for the receive beam pattern that the control circuit is programmed, or otherwise controlled, to generate.

If the control circuit (not shown in FIGS. 1-7) determines that the antenna unit 32 is to be inactive, then it generates, on each of the inner conductors $\mathbf{54}_1$-$\mathbf{54}_4$ of the respective signal ports $\mathbf{38}_1$-$\mathbf{38}_4$, a respective control signal that causes a corresponding one of the activation devices $\mathbf{40}_1$-$\mathbf{40}_4$ to uncouple the inner conductor from a corresponding one of the excitation points $\mathbf{42}_1$-$\mathbf{42}_4$ such that all of the inner conductors are uncoupled from all of the excitation points.

But if the control circuit (not shown in FIGS. 1-7) determines that the antenna unit 32 is to be active, then the control circuit determines which of the relative phases 0°, 90°, 270°, and 180° to impart to the signal (not shown in FIGS. 1-7) to be received by the antenna element 30.

Next, the control circuit (not shown in FIGS. 1-7) activates the activation device 40 associated with the relative phase that the control circuit determined to impart to the received signal (not shown in FIGS. 1-7), and deactivates the other activation devices. For example, if the control circuit determined to impart the relative phase 90° to the received signal, then the control circuit generates, on the inner conductor $\mathbf{54}_2$, a control signal having a value that causes the activation device 402 to couple the inner conductor $\mathbf{54}_2$ to the excitation point $\mathbf{42}_2$, and generates, on the inner conductors $\mathbf{54}_1$, $\mathbf{54}_3$, and $\mathbf{54}_4$, respective control signals having values that cause these activation devices to uncouple the inner conductors $\mathbf{54}_1$, $\mathbf{54}_3$, and $\mathbf{54}_4$ from the excitation points $\mathbf{42}_1$, $\mathbf{42}_3$, and $\mathbf{42}_4$, respectively.

Then, the antenna element 30 couples the received signal (not shown in FIGS. 1-7) to the location 64 of the transmission medium 34 associated with the activated activation device 40 via the corresponding excitation point 42, the activated activation device, the corresponding inner conductor 54, and the corresponding probe 62, to generate a receive version of the reference wave 36 (the signals received by all of the active antenna elements 30 are combined in the transmission medium to form the received version of the reference wave). For example, if the control circuit (not shown in FIGS. 4-7) determined to impart the relative phase 90° to the received signal, then the antenna element 30 couples the received signal to the location $\mathbf{64}_2$ via the excitation point $\mathbf{42}_2$, the activated activation device 402, the inner conductor $\mathbf{54}_2$, and the corresponding probe $\mathbf{62}_2$, to generate the receive version of the reference wave 36.

Next, the control circuit (not shown in FIGS. 1-7) receives the receive version of the reference wave 36 via a port (not shown in FIGS. 1-7) of the transmission medium 34, and analyzes the receive version of the reference wave. For example, if the control circuit and antenna that includes the antenna element 32 are part of a radar subsystem, then the control circuit analyzes the receive version of the reference wave 36 to determine whether an object lies in a path of the one or more radar receive beams (not shown in FIGS. 1-7).

The control circuit (not shown in FIGS. 1-7) repeats the above steps for one or more subsequent antenna receive radiation patterns. For example, the control circuit may repeat the above procedure to step the antenna that includes the antenna unit 32 through a time sequence of receive radiation patterns to steer each of the one or more main receive beams from a respective one direction to a respective other direction.

Still referring to FIGS. 1-7, alternate embodiments of the antenna unit 32 are contemplated. For example, the antenna unit 32 can have more or fewer than four phase paths (a phase path includes a excitation point 42 and corresponding activation device 40, signal port 38, probe 62, and iris 60) so as to provide more or fewer than four phases to a signal 76 radiated by an antenna element 30 and to a signal received by the antenna element. Furthermore, one or more of the antenna units 32 can be configured to impart a different number of phases to the radiated and received signals than one or more others of the antenna units. Moreover, one or more of the antenna units 32 can be configured to impart different values of phases to the radiated and received signals than one or more others of the antenna units. In addition, the width w of the antenna element 30 can approximately equal the length l so that the antenna element is configured to radiate and to receive signals along the edges 58 in addition to being configured to radiate and to receive signals along the edges 78; in such an embodiment, the vias 46 may be omitted, or may be moved away from the antenna element 30 along the x axis so that the vias are electrically uncoupled from the antenna element, although at least one other coupling path between the antenna element and the upper conductive boundary 50 would be needed to allow control/bias currents to flow through the devices 40 between the respective inner conductors 54 and the respective excitation points 42. For example, such a configuration of the antenna element 30 can support an antenna that is configured to radiate and to receive circularly polarized signals. Furthermore, although described as extending through an iris 60 into the transmission medium 34, each of one or more of the probes 62 may extend into, but not through, a respective iris, or may end a distance above the iris. Moreover, in addition to being configured to allow control of the phase of a signal radiated or received by the antenna element 30, the antenna unit 32 may be configured to allow control of the amplitude of the signal radiated or received by the antenna element. In addition, because the amplitude of the reference wave 36 typically decays as it propagates along the transmission medium 34, to keep the amplitudes of the radiated signals 76 and of the received signals uniform along a row of antenna units 32, a designer may "taper" the antenna units. For example, a designer may taper the sizes of the irises 60 or the impedances of the probes 62 such that the impedances of the couplers 48 decrease in a tapering fashion in the reference-wave propagation dimension (the x dimension in FIGS. 3-9) starting from a front end of the transmission medium 34 (i.e., the end having a signal port coupled to a reference-wave generator and receiver) to a termination end of the transmission medium. Examples of such tapering are disclosed in U.S. Provisional Patent Application No. 62/572,043, which is incorporated by reference. Furthermore, a termination end of the transmission medium 34 may be terminated in an impedance that approximately matches the characteristic impedance of the transmission medium to reduce or eliminate reflections of the reference wave 36 at the termination end. Moreover, the probes $\mathbf{62}_1$ and $\mathbf{62}_4$ may be disposed at different distances from the center line 80, and the probes $\mathbf{62}_2$ and $\mathbf{62}_3$ may be disposed at different distances from the center line. In addition, one or more of the signal ports 38 can be omitted, and the nodes of each of a corresponding one or more of the activation devices 40 can be coupled to a respective probe 62 at a location off (i.e., outside of), the antenna element 30. Furthermore, where the activation devices 40 are PIN diodes, each of one or more of the diodes can be reversed, such that the cathode is coupled to the signal port 38 and the anode is coupled to the excitation point 42; in such an alternative, the polarity of the DC bias voltage for coupled and uncoupled states would be reversed. Moreover, one or more embodiments described below in conjunction with FIGS. 8-18 may be applicable to the antenna element 30 and the antenna unit 32.

Figure 8:
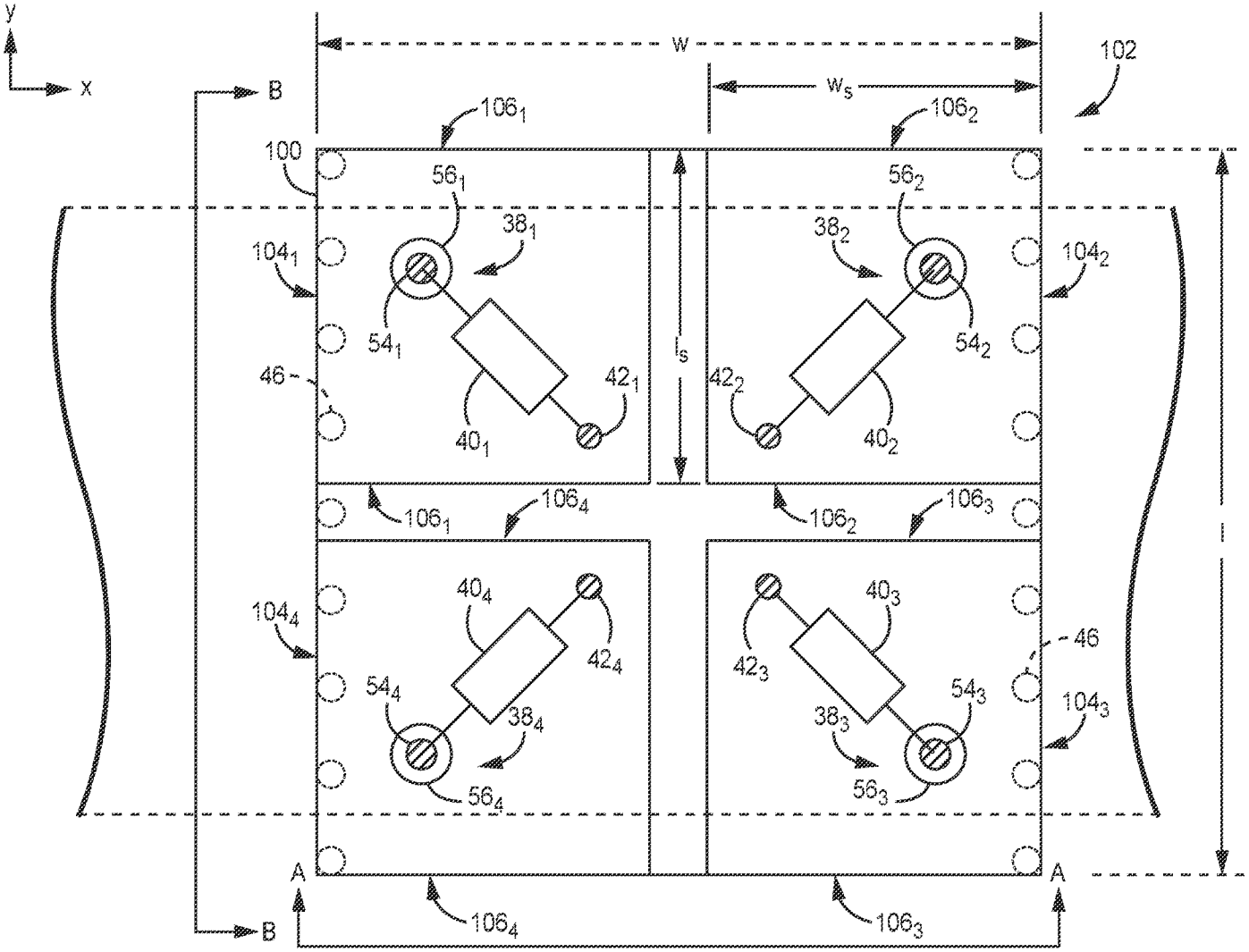
FIG. 8 is a plan view of an antenna unit of an antenna array, according to another embodiment.

FIG. 8 is a plan view of an antenna element 100 of an antenna unit 102, according to another embodiment. In FIG. 8, components common to FIGS. 1-7 are labeled with like reference numbers.

Like the antenna unit 32 of FIG. 1, the antenna unit 100 is configured to impart, to a radiated or received signal, one of multiple phases. For example, the antenna unit 100, like the antenna unit 32, is configured to impart to a radiated or received signal one of four relative phases 0°, 90°, 270°, and 180°.

But unlike the single-section antenna element 30 of FIG. 1, the antenna element 100 includes multiple sections 104, one section per signal port 38. For example, the antenna element 100 has four signal ports $\mathbf{38}_1$-$\mathbf{38}_2$ and four sections $\mathbf{104}_1$-$\mathbf{104}_4$, one section per signal port.

Each section 104 is a conductor that is, ideally, planar, and, together, the sections occupy an area of approximately w×l, which is the same area that the antenna element 30 of FIG. 1 occupies.

Because the antenna element 100 includes one section 104 per signal port 38, the control signal (e.g., a DC-bias control voltage where the activation devices 40 are PIN diodes) can be applied to the section itself instead of to the respective inner conductor 54. A circuit configured to apply the control signal to the section 104 may be less complex, and may include fewer components, than a circuit configured to apply the control signal to the respective inner conductor 54 as described above in conjunction with FIGS. 1-7.

Furthermore, because each section 104 has a length $l_s \approx \lambda_m/4$ in the y dimension ($\lambda_m$ is the wavelength of the reference wave in the medium that is immediately below the antenna element 100), each section is configured to radiate/receive along its respective edges 106 in a manner similar to the manner in which a quarter-wavelength antenna element (e.g., a planar inverted F antenna (PIFA)) is configured to radiate/receive. The radiating and receiving of a quarter-wavelength antenna element is described below in conjunction with FIG. 14.

Moreover, each section 104 has a width $w_s$ in the x dimension, and a designer can adjust $w_s$, for example, to adjust the impedance of the section at the respective excitation point 42.

Operation of the antenna unit 102 can be similar to the operation of the antenna unit 32 of FIG. 1 as described above in conjunction with FIGS. 1-7, except that only the active antenna unit 104 radiates and receives signals in a manner similar to the manner in which a planar, resonant quarter-wavelength antenna element radiates and receives signals.

Still referring to FIG. 8, alternate embodiments of the antenna unit 102 are contemplated. For example, one or more embodiments described above in conjunction with FIGS. 1-7 and described below in conjunction with FIGS. 9-18 may be applicable to the antenna element 100 and the antenna unit 102.

Figure 9:
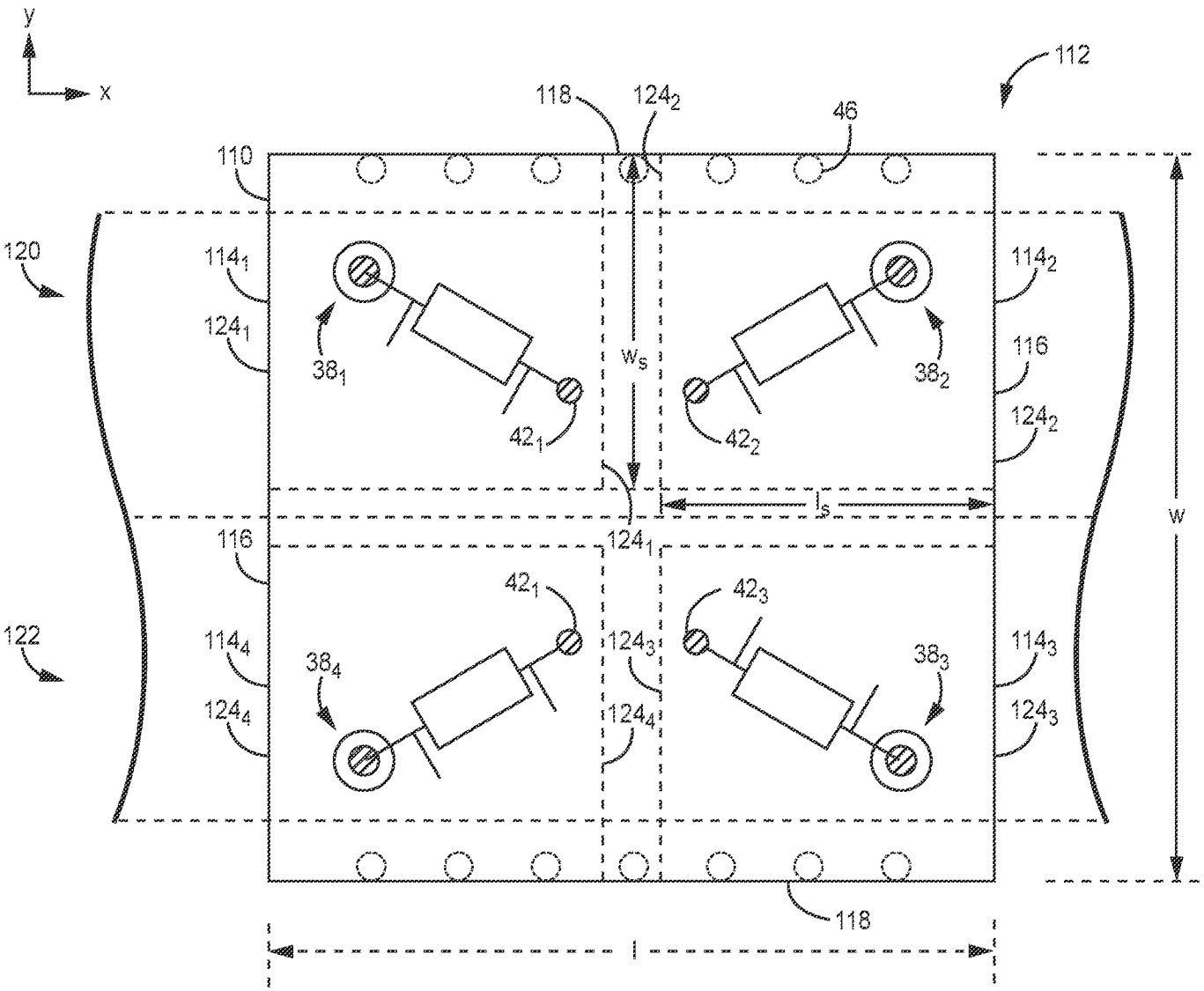
FIG. 9 is a plan view of an antenna unit of an antenna array, according to yet another embodiment.

FIG. 9 is a plan view of an antenna element 110 of an antenna unit 112, according to another embodiment. In FIG. 9, components common to FIGS. 1-8 are labeled with like reference numbers.

The antenna element 110 can be a single-section antenna similar to the antenna element 30 of FIG. 1; alternatively, the antenna element 110 can include multiple sections 114 (shown partially in dashed line), which can be similar to the antenna sections 104 of the antenna element 100 of FIG. 8.

Like the antenna units 32 and 102 of FIGS. 1 and 8, respectively, the antenna unit 112 can impart, to a radiated or received signal, one of multiple phases. For example, the antenna unit 110, like the antenna units 32 and 102, can impart, to a radiated or received signal, one of four relative phases 0°, 90°, 270°, and 180°.

But unlike the antenna elements 30 and 100 of FIGS. 1 and 8, respectively, the antenna element 110 is configured to radiate and to receive signals along y-dimension edges 116 instead of along x-dimension edges 118. Configuring the antenna element 110 to radiate and to receive signals along the y-dimension edges 116 can reduce the magnitudes of undesirable cross-polarized signal components that the antenna element 110 may generate and receive as compared to the magnitudes of undesirable cross-polarized signal components that may be generated and received by an antenna element configured to radiate and to receive signals along its x-dimension edges.

As described above in conjunction with FIGS. 3-7, for the antenna units 32 and 102 of FIGS. 1 and 8, respectively, it is the electric-field distributions (e.g., of the plots 90 and 92) in the y dimension beneath the antenna elements 30 and 100 that provide the 180° phase difference between the signal ports $\mathbf{38}_1$ and $\mathbf{38}_4$, and between the signal ports $\mathbf{38}_2$ and $\mathbf{38}_3$.

But because the antenna element 110 is configured to radiate and to receive signals along its y-dimension edges 116, the electric-field distribution beneath the antenna element along the y dimension does not provide a 180° phase difference between the signal ports $\mathbf{38}_1$ and $\mathbf{38}_4$, and between the signal ports $\mathbf{38}_2$ and $\mathbf{38}_3$.

To provide a 180° phase difference between the signal ports $\mathbf{38}_1$ and $\mathbf{38}_4$, and between the signal ports $\mathbf{38}_2$ and $\mathbf{38}_3$, of the antenna unit 112, instead of one transmission medium being disposed beneath the antenna element 110, two transmission media 120 and 122 (shown in dashed line) are disposed beneath the antenna element and are configured to carry respective reference waves having, ideally, the same frequency but being, ideally, 180° out of phase with one another. The transmission medium 120 lies beneath the portion of the antenna element 110 in which the signal ports $\mathbf{38}_1$ and $\mathbf{38}_2$ are disposed, and the transmission medium 122 lies beneath the portion of the antenna element in which the signal ports $\mathbf{38}_3$ and $\mathbf{38}_4$ are disposed. Furthermore, each transmission medium 120 and 122 can be similar to the transmission medium 34 described above in conjunction with FIGS. 2-7. Similarly, each reference wave respectively carried by the transmission media 120 and 122 can be similar to the reference wave 36 described above in conjunction with FIGS. 2-7.

The antenna element 110 has a length $l \approx \lambda_m/2$ in the x dimension, and has, in the y dimension, a width w that can have any suitable value, for example, to cause the antenna element to have a particular impedance at one of the excitation points 42 ($\lambda_m$ is the wavelength of the reference wave in the medium that is immediately below the antenna element 110).

And if the antenna element 110 is multi-sectional, then each section 114 has a length $l_s \approx \lambda_m/4$ long in the x dimension, and is configured to radiate/receive along its respective edges 124 in a manner similar to the manner in which a quarter-wavelength planar antenna element (e.g., a planar inverted F antenna (PIFA)) is configured to radiate/receive. The radiating and receiving of a quarter-wavelength planar antenna element is described below in conjunction with FIG. 14. Furthermore, each antenna section 114 has a width $w_s$ in the y dimension, and a designer can adjust $w_s$, for example, to adjust the impedance of the antenna section at the respective excitation point 42.

Operation of the antenna unit 112 can be similar to the operation of the antenna unit 32 of FIG. 1 as described above in conjunction with FIGS. 1-7, or can be similar to the operation of the antenna unit 102 of FIG. 8 if the antenna element 110 includes sections 114, except that the antenna element 110, or active antenna section 114, radiates and receives signals along its y-dimension edges 116/124 instead of along its x-dimension edges.

Still referring to FIG. 9, alternate embodiments of the antenna unit 112 are contemplated. For example, one or more embodiments described above in conjunction with FIGS. 1-8 and below in conjunction with FIGS. 10-18 may be applicable to the antenna element 110 and the antenna unit 112.

Figure 10:
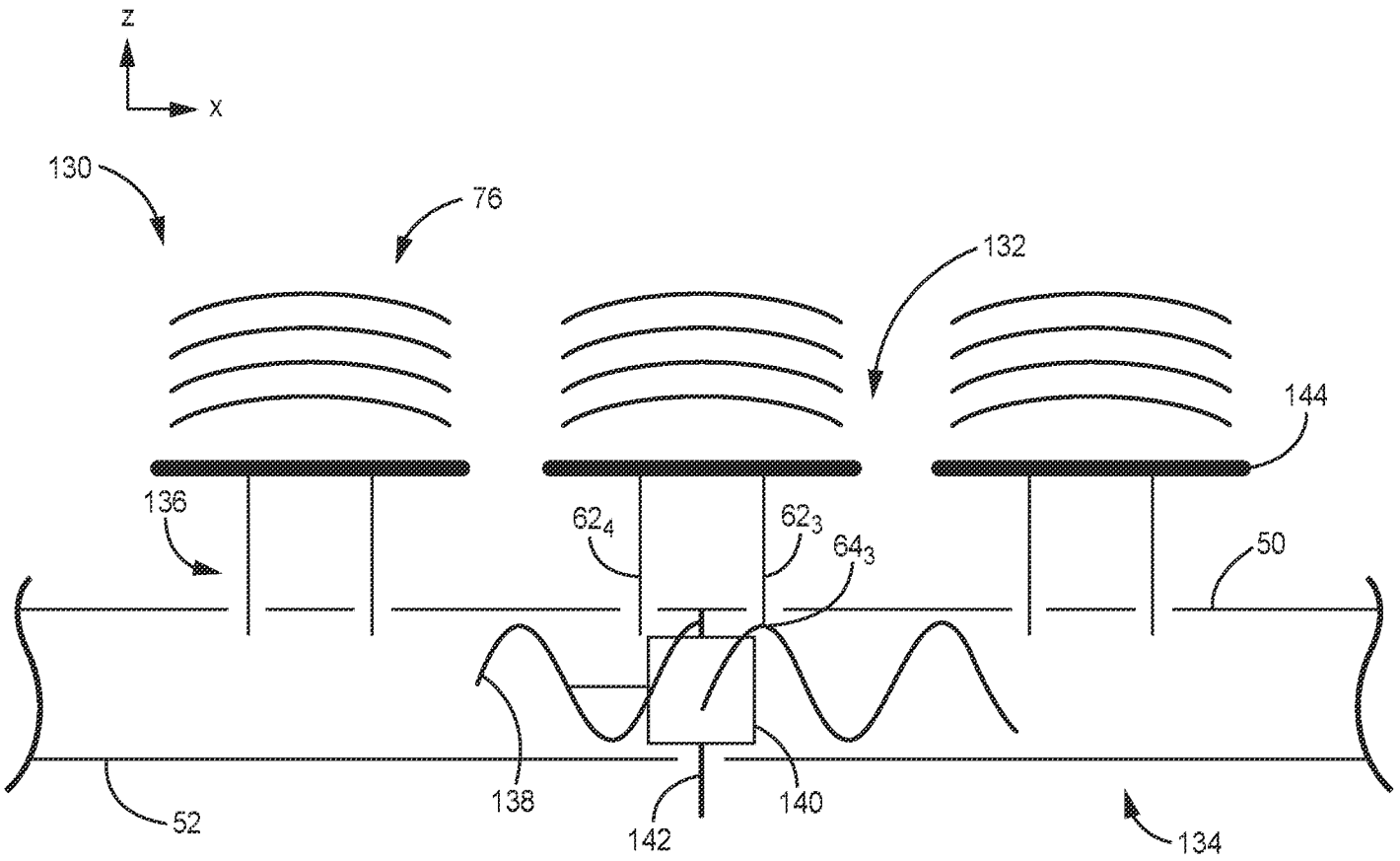
FIG. 10 is a cutaway side view of a portion of an antenna array that includes one or more of the antenna units of FIGS. 1-9, and that includes at least one tuning structure, such as a phase tuner, each disposed in a transmission medium between portions of a respective antenna unit, according to an embodiment.

FIG. 10 is a cutaway partial side view of an antenna 130, which is configured to provide more than four phase choices per antenna unit 132, according to an embodiment. In FIG. 10, components common to FIGS. 1-9 are labeled with like reference numbers.

The antenna 130 includes a number of antenna units 132 (three antenna units in a row shown in FIG. 10) disposed over one or more transmission media 134. For example, the antenna 130 can include one transmission medium 134 per row 136 of antenna units 132 such as described above in conjunction with FIGS. 1-8. Each of the antenna units 132 can be similar to one of the antenna units 32, 102, or 112 of FIGS. 1, 8, and 9, respectively, and the transmission medium 134 can be similar to the transmission medium 34 of FIGS. 2-7. Alternatively, the antenna 130 can include two transmission media per row 136 of antenna units 132, where the two transmission media are constructed and located similar to the transmission media 120 and 122 of FIG. 8, and are configured to carry reference waves 138 of equal magnitude and opposite polarity.

One or more tuning structures 140 (only one tuning structure shown in FIG. 12) are disposed in each of the one or more transmission media 134, and allow adjustment of the phase difference between the probes $\mathbf{62}_4$ and $\mathbf{62}_3$, and of the phase difference between the probes $\mathbf{62}_1$ and $\mathbf{62}_2$ (not visible in FIG. 10), to other than 90°. If there is only one tuning structure 140 between the probes $\mathbf{62}_1$ and $\mathbf{62}_2$ and between the probes $\mathbf{62}_3$ and $\mathbf{62}_4$, then the tuning structure can be configured to provide the same phase difference between the probes $\mathbf{62}_1$ and $\mathbf{62}_2$ as it provides between the probes $\mathbf{62}_4$ and $\mathbf{62}_3$. Alternatively, disposing two tuning structures 140 (only one tuning structure visible in FIG. 10) beneath the antenna unit 132 allow a control circuit (not shown in FIG. 10) to set the phase difference between the probes $\mathbf{62}_1$ and $\mathbf{62}_2$ and the phase difference between the probes $\mathbf{62}_4$ and $\mathbf{62}_3$ to different values.

Each of the one or more tuning structures 140 can be of any suitable type and have any suitable configuration. For example, one or more of the one or more tuning structures 140 can be a varactor, which is a diode having a capacitance that varies in response to changes in the reverse-bias voltage applied across the diode.

Each of the tuning structures 140 has at least one control node 142 configured to receive a control signal for controlling the phase shift that the tuning structure imparts to the reference wave. For example, if a tuning structure 140 is a varactor and the conductive upper member 50 of the transmission medium 134 is held at a reference voltage such as ground, then the control node 142 can be coupled to the anode of the varactor via an opening or signal port in the conductive bottom member 52 of the transmission medium. A control circuit (not shown in FIG. 10) can be configured to generate, on the control node 142, a control signal. For example, where the tuning structure 140 is a varactor, then a control circuit can be configured to generate, on the control node 142, a control voltage that is less than the voltage on the member 50 to reverse bias the varactor, and can be configured to adjust this control voltage in a digital or continuous/analog manner to adjust the varactor's capacitance, and, therefore, to adjust the phase shift that the varactor imparts to the reference wave between the probes $\mathbf{62}_4$ and $\mathbf{62}_3$ (and possibly also between the probes $\mathbf{62}_1$ and $\mathbf{62}_2$). Said another way, by varying the reactance of the tuning structure 140, the control circuit can vary the length of the electrical path between the probes $\mathbf{62}_4$ and $\mathbf{62}_3$ (and possibly also between the probes $\mathbf{62}_1$ and $\mathbf{62}_2$).

Still referring to FIG. 10, operation of an antenna unit 132 and of the transmission medium 134 of the antenna 130 is described during a transmit mode of the antenna, according to an embodiment. For example, if the antenna 130 is part of a radar subsystem, then the antenna generates one or more main transmit radar beams.

A control circuit (not shown in FIG. 10) controls a signal generator (not shown in FIG. 10) to generate the transmit version of the reference wave 138 as a sinusoid having a suitable frequency f and wavelength λ. For example, for a radar application, the reference wave 138 may have a frequency in an approximate range of 5 GHz-110 GHz.

Next, the control circuit (not shown in FIG. 10) determines whether to activate or deactivate the antenna unit 132. For example, the control circuit may base this determination on whether the antenna unit 132 is to be active or inactive for the beam pattern that the control circuit is programmed, or otherwise controlled, to generate.

If the control circuit (not shown in FIG. 10) determines that the antenna unit 132 is to be inactive, then the control circuit generates, on each of the inner conductors $\mathbf{56}_1$-$\mathbf{56}_4$ of the signal ports $\mathbf{38}_1$-$\mathbf{38}_4$ (not visible in FIG. 10) a respective control signal that causes the activation devices $\mathbf{40}_1$-$\mathbf{40}_4$ (not visible in FIG. 10) to uncouple the inner conductors from the respective excitation points $\mathbf{42}_1$-$\mathbf{42}_4$ (not visible in FIG. 10) such that all of the inner conductors are uncoupled from all of the excitation points.

But if the control circuit (not shown in FIG. 10) determines that the antenna unit 132 is to be active, then the control circuit determines what phase to impart to the signal 76 to be radiated by an antenna element 144 of the antenna unit 132.

Because the relative phases at the signal ports $\mathbf{38}_1$-$\mathbf{38}_4$ are 90° apart from one another, adjusting the tuning structure 140 generates four relative phases that are different from 0°, 90°, 270°, and 180° but that are still 90° apart from one another. For example, if the control circuit (not shown in FIG. 10) determines that it is to impart a relative phase of 168° to the signal 76, then the control circuit generates, on the control node 142, a control signal having a value that causes the tuning structure 140 to add 78° to the phase shift between the probes $\mathbf{62}_4$ and $\mathbf{62}_3$ such that the relative phases at the signal ports $\mathbf{38}_1$-$\mathbf{38}_4$ are, effectively, 78°, 168°, 348°, and 258°. This example assumes that the tuning structure 140 does not also generate a phase shift between the probes $\mathbf{62}_1$ and $\mathbf{62}_2$.

Next, the control circuit (not shown in FIG. 10) generates a control signal having a value that causes the tuning structure 140 to generate a phase shift between the probes $\mathbf{62}_4$ and $\mathbf{62}_3$ such that the phase at one of the signal ports $\mathbf{38}_1$-$\mathbf{38}_4$ is the phase to be imparted to the signal 76. For example, if the phase to be imparted to the signal 76 is 107°, then the control circuit generates the control signal having a value that causes the tuning structure 140 to add 17° to the phase shift between the probes $\mathbf{62}_4$ and $\mathbf{62}_3$ such that the relative phases at the signal ports $\mathbf{38}_1$-$\mathbf{38}_4$ are 17°, 107°, 287°, and 197°.

Then, the control circuit (not shown in FIG. 10) activates the activation device 40 (FIGS. 1, 8, and 9) associated with the relative phase that the control circuit determined to impart to the signal 76, and deactivates the other activation devices. For example, if the control circuit determined to impart the relative phase 107° to the signal 76, then the control circuit generates, on the inner conductor $\mathbf{54}_2$, a control signal having a value that activates the activation device 402 to couple the inner conductor $\mathbf{54}_2$ to the excitation point $\mathbf{42}_2$, and generates, on the inner conductors $\mathbf{54}_1$, $\mathbf{54}_3$, and $\mathbf{54}_4$, respective control signals having values that deactivate these activation devices to uncouple the inner conductors $\mathbf{54}_1$, $\mathbf{54}_3$, and $\mathbf{54}_4$ from the excitation points $\mathbf{42}_1$, $\mathbf{42}_3$, and $\mathbf{42}_4$, respectively.

Next, the probe 62 associated with the activated device 40 couples the reference wave 138 at the respective location 64 to the associated excitation point 42 via the activated device to excite the antenna element 144. For example, if the control circuit (not shown in FIG. 10) determined to impart the relative phase 107° to the signal 76, then the probe $\mathbf{62}_2$ (not visible in FIG. 10) couples the reference wave 138 at the location $\mathbf{64}_2$ (not visible in FIG. 10) to the excitation point $\mathbf{42}_2$ via the activated device 402.

Then, the excited antenna element 144 radiates, in response to the signal at the excitation point 42 associated with the activated device 40, the signal 76 having the relative phase associated with the excitation point. For example, if the control circuit (not shown in FIG. 10) activates the device 402, then the antenna element 144 radiates the signal 76 having a relative phase of 107°.

The control circuit (not shown in FIG. 10) repeats the above steps for one or more subsequent antenna transmit radiation patterns. For example, the control circuit may repeat the above procedure to step an antenna that includes the antenna unit 132 through a time sequence of transmit radiation patterns to steer each of one or more main transmit beams from a respective one direction to a respective other direction.

Still referring to FIG. 10, operation of the antenna unit 132 is described during a receive mode of the antenna 130, according to an embodiment. For example, if the antenna is part of a radar subsystem, then the antenna generates one or more main radar receive beams.

A control circuit (not shown in FIG. 10) determines whether to activate or deactivate the antenna unit 132. For example, the control circuit may base this determination on whether the antenna unit 132 is to be active or inactive for the receive beam pattern that the control circuit is programmed, or otherwise controlled, to generate.

If the control circuit (not shown in FIG. 10) determines that the antenna unit 132 is to be inactive, then the control circuit generates, on each of the inner conductors $\mathbf{54}_1$-$\mathbf{54}_4$ of the respective signal ports $\mathbf{38}_1$-$\mathbf{38}_4$ (e.g., FIG. 9) a respective control signal that uncouples the inner conductor from the respective one of the excitation points $\mathbf{42}_1$-$\mathbf{42}_4$ such that all of the inner conductors are uncoupled from all of the excitation points.

But if the control circuit (not shown in FIG. 10) determines that the antenna unit 132 is to be active, then the control circuit determines what relative phase to impart to the signal (not shown in FIG. 10) to be received by the antenna element 144.

Because the relative phases at the signal ports $\mathbf{38}_1$-$\mathbf{38}_4$ are 90° apart from one another, adjusting the tuning structure 140 generates four relative phases that are different from 0°, 90°, 180°, and 270° but that still maintain the 90° separation. For example, if the control circuit (not shown in FIG. 10) determines that it is to impart a phase of 168° to the signal 76, then the control circuit generates a control signal having a value that causes the tuning structure 140 to add 78° to the phase shift between the probes $\mathbf{62}_4$ and $\mathbf{62}_3$ such that the relative phases at the signal ports $\mathbf{38}_1$-$\mathbf{38}_4$ are 78°, 168°, 328°, and 258°, respectively.

Next, the control circuit (not shown in FIG. 10) generates, on the control node 142, a control signal having a value that causes the tuning structure 140 to generate a phase shift between the probes $\mathbf{62}_4$ and $\mathbf{62}_3$ such that the phase at one of the signal ports $\mathbf{38}_1$-$\mathbf{38}_4$ is the phase to be imparted to the signal received by the antenna element 144. For example, if the phase to be imparted to the received signal is 107°, then the control circuit generates the control signal having a value that causes the tuning structure 140 to add 17° to the phase shift between the probes $\mathbf{62}_4$ and $\mathbf{62}_3$ such that the phases at the signal ports $\mathbf{38}_1$-$\mathbf{38}_4$ are 17°, 107°, 287°, and 197°, respectively.

Then, the control circuit (not shown in FIG. 10) activates the activation device 40 associated with the relative phase that the control circuit determined to impart to the received signal (not shown in FIG. 10), and deactivates the other activation devices. For example, if the control circuit determined to impart the relative phase 107° to the received signal, then the control circuit generates, on the inner conductor $\mathbf{54}_2$, a control signal having a value that causes the activation device 402 to couple the inner conductor $\mathbf{54}_2$ to the excitation point $\mathbf{42}_2$, and generates, on the inner conductors $\mathbf{54}_1$, $\mathbf{54}_3$, and $\mathbf{54}_4$, respective control signals having values that cause these devices to uncouple the inner conductors $\mathbf{54}_1$, $\mathbf{54}_3$, and $\mathbf{54}_4$ from the excitation points $\mathbf{42}_1$, $\mathbf{42}_3$, and $\mathbf{42}_4$, respectively.

Next, the antenna element 144 couples the received signal (not shown in FIG. 10) to the location 64 of the transmission medium 134 associated with the activated activation device 40 via the corresponding excitation point 42, the activated device, the corresponding inner conductor 54, and the corresponding probe 62, to generate the receive version of the reference wave 138 (the signals received by all of the active antenna elements 144 are combined in the transmission medium to form the receive version of the reference wave). For example, if the control circuit (not shown in FIG. 10) determined to impart the relative phase 107° to the received signal, then the antenna element 144 couples the received signal to the location $\mathbf{64}_2$ (not visible in FIG. 10) via the excitation point $\mathbf{42}_2$, the activated device 402, the inner conductor $\mathbf{54}_2$, and the corresponding probe $\mathbf{62}_2$, to generate the reference wave 138.

Then, the control circuit (not shown in FIG. 10) receives the receive version of the reference wave 138 via a port (not shown in FIG. 10) of the transmission medium 134, and analyzes the reference wave. For example, if the control circuit and antenna that includes the antenna element 144 are part of a radar subsystem, then the control circuit analyzes the receive version of the reference wave to determine whether an object lies in a path of the one or more radar receive beam (not shown in FIG. 10).

The control circuit (not shown in FIG. 10) repeats the above steps for one or more subsequent antenna receive radiation patterns. For example, the control circuit may repeat the above procedure to step the antenna that includes the antenna unit 132 through a time sequence of receive radiation patterns to steer each of the one or more main receive beams from a respective one direction to a respective other direction.

Still referring to FIG. 10, alternate embodiments of the antenna 130 and the antenna unit 132 are contemplated. For example, suitable types of the tuning structure 140 other than a varactor include a non-varactor diode, ferromagnetic structures and devices, piezoelectric structures and devices, and liquid-crystal structures and devices. Furthermore, one or more of the embodiments described above in conjunction with FIGS. 1-9 and below in conjunction with FIGS. 11-18 may be applicable to the antenna 130 or the antenna unit 132.

Figure 11:
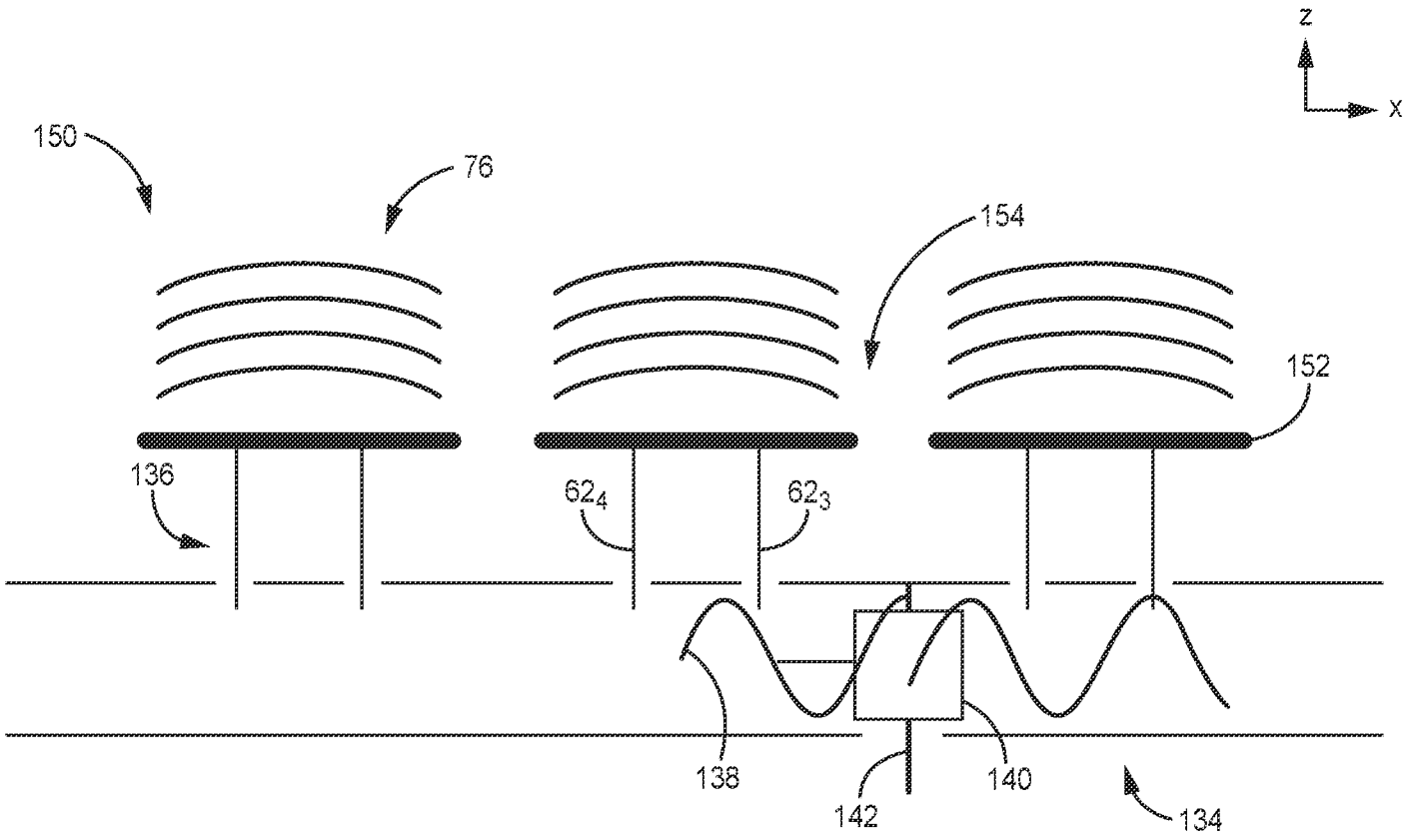
FIG. 11 is a cutaway side view of a portion of an antenna array that includes one or more of the antenna units of FIGS. 1-9, and that includes at least one tuning structure, such as a phase tuner, each disposed in a transmission medium between a respective pair of antenna units, according to an embodiment.

FIG. 11 is a cutaway partial side view of an antenna 150, which is configured to provide a phase shift between a signal radiated/received by one antenna element 152 and a signal radiated/received by another antenna element in a same row 136 of antenna units, according to an embodiment. In FIG. 11, components common to FIGS. 3-12 are labeled with like reference numbers.

The antenna 150 is similar to the antenna 130 of FIG. 10, except that the antenna 150 includes at least one tuning structure 140 (e.g., a varactor diode) disposed between adjacent antenna units 154 instead of between probes 62 of a same antenna unit.

Locating the tuning structure 140 in the transmission medium 134 between adjacent antenna units 154 allows varying the phase difference of the reference wave between the adjacent antenna units, and, therefore, allows varying the phase difference between a signal radiated/received by the antenna element 152 of one of the antenna units and a signal radiated/received by the antenna element of the other one of the antenna units. Said another way, by varying the reactance of the tuning structure 140, a control circuit (not shown in FIG. 11) can vary the length of the electrical path between the adjacent antenna units 154.

Being able to vary the phase difference between signals radiated/received by different antenna units 154 can allow a control circuit (not shown in FIG. 11) to steer one or more main transmit/receive beams with a finer resolution as compared to an antenna lacking the ability to vary the phase difference between signals radiated/received by different antenna units.

In an example, if the control circuit (not shown in FIG. 11) causes the tuning structure 140 to shift the phase of the reference wave 138 by 20°, then the tuning structure effectively shifts the phases of the signals at all of the signal ports $\mathbf{38}_1$-$\mathbf{38}_4$ (not shown in FIG. 11) of the "downstream" antenna unit 154 by 20° such that effectively, the shifted phases at the respective signal ports are 20°, 110°, 290°, and 200°, respectively.

Still referring to FIG. 11, alternate embodiments of the antenna 150 and the antenna unit 154 are contemplated. For example, if the antenna 150 includes two parallel transmission media such as the transmission media 120 and 122 of FIG. 9, then the antenna may include, between a pair of adjacent antenna units 154, at least one respective tuning structure 140 per each transmission medium; each such tuning structure can be configured for independent control by a control circuit (not shown in FIG. 11). Furthermore, the antenna 150 can include one more tuning structures 140 disposed between respective pairs of adjacent antenna units 154 as described in conjunction with FIG. 11, and can also include one or more tuning structures each disposed between probes 62 of a respective same antenna unit as described above in conjunction with FIG. 10. Moreover, one or more of the embodiments described above in conjunction with FIGS. 1-10 and below in conjunction with FIGS. 12-18 may be applicable to the antenna 150 or one or more of the antenna units 154.

Figure 12:
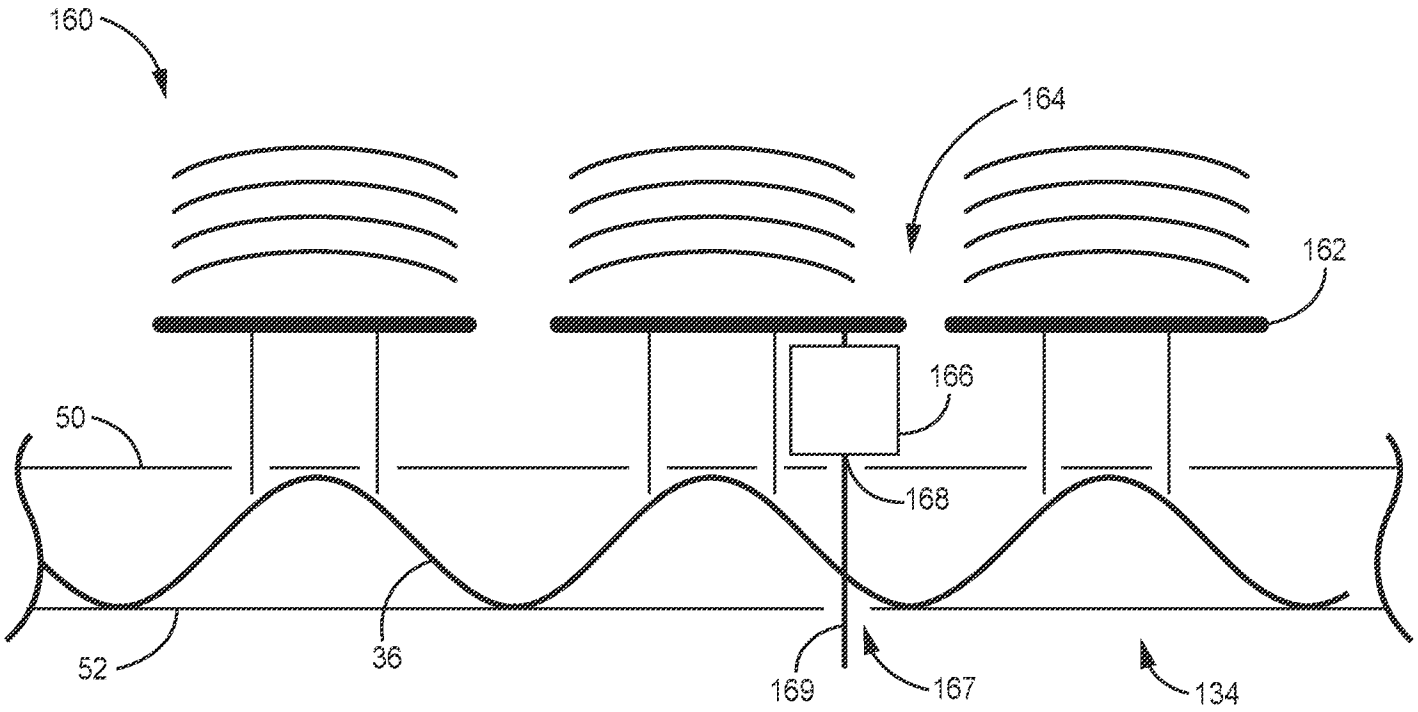
FIG. 12 is a cutaway side view of an antenna array that includes one or more of the antenna units of FIG. 1-9, where each of at least one of the antenna units of the antenna array includes a respective tuning structure, such as a phase tuner, according to an embodiment.

FIG. 12 is a cutaway partial side view of an antenna 160, which is configured to provide a phase shift to a signal radiated/received by an antenna element 162, according to an embodiment. In FIG. 12, components common to FIGS. 1-11 are labeled with like reference numbers.

The antenna 160 is similar to the antennas 130 and 150 of FIGS. 10-11, except that the antenna 160 includes at least one antenna unit 164 having a tuning structure 166 coupled to the antenna element 162. The tuning structure 166 may be similar to the tuning structure 140 of FIGS. 10-11 (e.g., the tuning structure 166 may be a varactor diode).

Coupling the tuning structure 166 to the antenna element 162 allows a control circuit (not shown in FIG. 12) to vary, directly, the phase of a signal radiated/received by the antenna element. For example, if the tuning structure 166 is a varactor, then the anode of the of the varactor can be configured to act as a control node 168, which is coupled to the control circuit via a control port 167 disposed in, or adjacent to, the antenna unit 164; for example, the control port 167 is formed in the conductive lower layer 52 of the transmission medium 134 and has an inner conductor 169, and the structure of the control port can be similar to one of the signal ports 38. The tuning structure shifts the phase of the signal radiated/received by the antenna element 162 by loading the antenna element with a reactance having a value corresponding to the value of the control voltage. Alternatively, the control node of the tuning structure 166 can be the antenna element 162 itself, and, where the tuning structure is a varactor, the anode of the varactor can be coupled to a reference voltage such as ground; that is, the control circuit can apply the control voltage directly to the antenna element such that the tuning structure shifts the phase of the signal radiated/received by the antenna element by loading the antenna element with a reactance having a value corresponding to the value of the control voltage.

Being able to vary, directly, the phase of signals radiated/received by one or more antenna units 162 can allow a control circuit (not shown in FIG. 12) to steer one or more main transmit/receive beams with a finer resolution as compared to an antenna lacking the ability to vary the phase of one or more signals radiated/received by different antenna units.

For example, if the control circuit (not shown in FIG. 12) causes the tuning structure 166 to shift the phase of the radiated/received signal by 20°, then the tuning structure effectively shifts the phases of the signals at all of the signal ports $\mathbf{38}_1$-$\mathbf{38}_4$ (not visible in FIG. 14) by 20° such that effectively, the shifted phases at the respective signal ports are: 20°, 110°, 290°, and 200°, respectively.

Still referring to FIG. 12, alternate embodiments of the antenna 160 and of the antenna unit 164 are contemplated. For example, in addition to one or more of the tuning structures 166, the antenna 160 can include one more tuning structures 140 disposed in the transmission medium 134 between respective pairs of adjacent antenna units 164 as described above in conjunction with FIG. 11, and can also include one or more tuning structures each disposed between probes 62 of a respective same antenna unit as described above in conjunction with FIG. 10. Furthermore, instead of including a tuning structure 166 coupled to the antenna element 162, each of one or more of the antenna units 164 may include tuning structures 166 each disposed between a respective probe 62 and a corresponding inner conductor 54. Moreover, instead of being a varactor, the tuning structure 166 can be configured to alter the effective resonant frequency of the antenna element 162 so as to impart a discrete phase shift, for example, 45°, to the signals radiated and received by the antenna element, and, therefore, so as to impart, effectively, a third bit of phase resolution to the antenna unit 164. For example, in such an embodiment, the tuning structure may be a PIN diode having its cathode coupled to the antenna element 162 and having its anode acting as the control node 168, or a field-effect transistor (FET) having one of its drain/source coupled to the antenna element, the other of its drain/source coupled to a reference voltage such as ground, and its gate acting as the control node 168. Furthermore, one or more of the embodiments described above in conjunction with FIGS. 1-11 and below in conjunction with FIGS. 13-18 may be applicable to the antenna 160 or to one or more of the antenna units 164.

Figure 13:
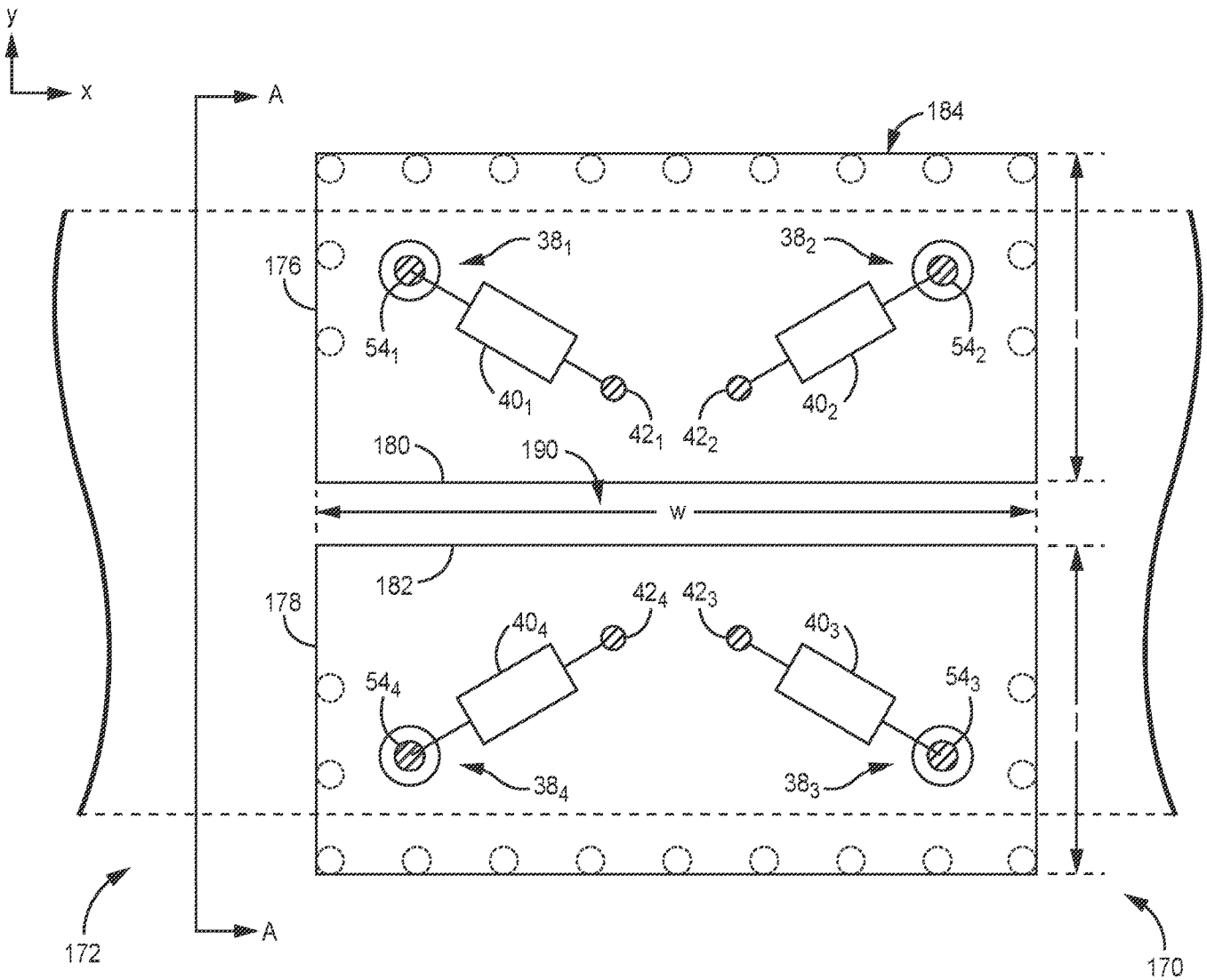
FIG. 13 is a plan view of an antenna unit of an antenna array, according to still another embodiment.

FIG. 13 is a plan view of an antenna element 170 of an antenna unit 172, according to an embodiment.

Figure 14:
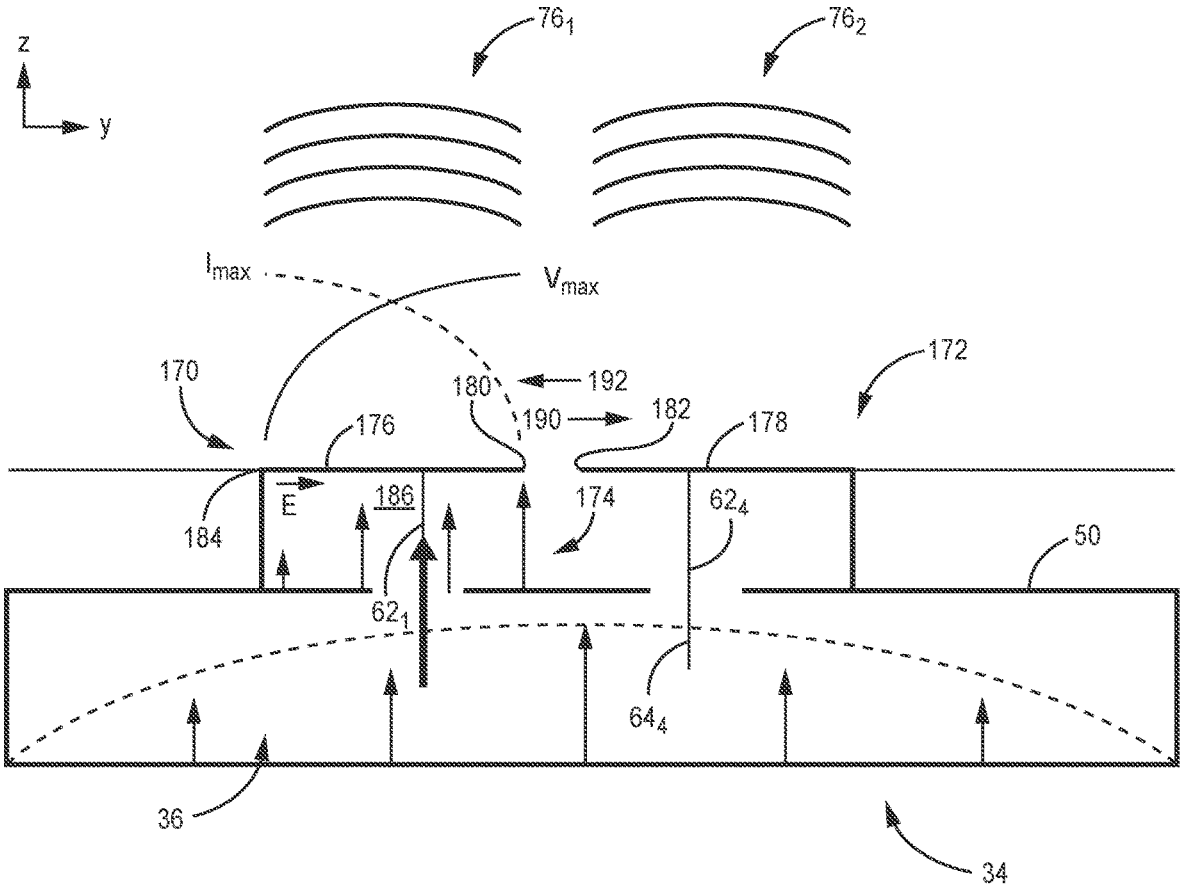
FIG. 14 is a cutaway side view of the antenna unit of FIG. 13 and of a transmission medium, and includes a plot of an electric field between the transmission medium and one of the antenna-element sections of the antenna unit, according to an embodiment.

FIG. 14 is a side view of the antenna unit 172 taken along lines A-A of FIG. 13, of a plot 174 of an electric field overlaying a portion of the antenna unit, and of a transmission medium 34 (a waveguide in an embodiment) disposed beneath at least a portion of the antenna unit, according to an embodiment.

Referring to FIGS. 13-14, the antenna unit 172 is similar to the antenna unit 112 of FIG. 9 except that as described below, the antenna unit 172 includes the antenna element 170 having two sections 176 and 178, according to an embodiment in which each of the sections is a respective planar inverting F antenna (PIFA).

The length l of each antenna section 176 and 178 in the in the y dimension is set to approximately $\lambda_m/4$ so that the antenna section operates in a resonant mode (l may not be set exactly to $\lambda_m/4$ so that, for example, the real part of the impedance of the antenna section has a minimum, or another particular, value that may facilitate resonant-mode operation).

The width w of each antenna section 176 and 178 in the x dimension can have any suitable value, for example, to set impedances of each antenna section at the excitation points 42 to particular values that facilitate resonant operation of the antenna sections.

Furthermore, the antenna sections 176 and 178 have respective signal-radiating/signal-receiving edges 180 and 182.

In a transmit mode, assuming that the antenna section 176 is active and the antenna section 178 is inactive (in an embodiment, only one antenna section is active at a time), the antenna section 176 is excited with a signal from one of the two signal ports $\mathbf{38}_1$-$\mathbf{38}_2$ associated with the active antenna section, and, in response to this excitation signal, the antenna section generates a current I that is zero at the radiating edge 180 and that fluctuates between $\pm I_{max}$ at an opposite, non-radiating edge 184, which is coupled to the conductive upper boundary 50 of the transmission medium 34. If the transmit version of the reference wave 36 is sinusoidal, then a profile of the current I is a quarter sinusoid having, at the edge 184, an amplitude that fluctuates sinusoidally between $+I_{max}$ and $-I_{max}$.

Further in response to the excitation signal, the active antenna section 176 generates, between it and the conductive upper boundary 50 of the transmission medium 34, a voltage V that is zero at the non-radiating edge 184 and that fluctuates between $\pm V_{max}$ at the radiating end 180. If the transmit version of the reference wave 36 is sinusoidal, then the profile of the voltage V is a quarter sinusoid having, at the radiating edge 180, an amplitude that fluctuates sinusoidally between $+V_{max}$ and $-V_{max}$. And because the electric field $\vec{E}$ is in units of V/m, the amplitude of the electric field $\vec{E}$ follows the amplitude of the voltage V.

Because the current I flowing in the active antenna section 176 is effectively cancelled by a current of an equal magnitude and opposite polarity flowing beneath the antenna section in the conductive boundary 50, the current I does not induce the signal $\mathbf{76}_1$ that the antenna section radiates.

Furthermore, because the voltage V is confined to an intermediate region 186 between the antenna section 176 and the boundary 50, the voltage V also does not induce the signal $\mathbf{76}_1$ that the antenna section radiates.

But the electric field $\vec{E}$ has one or more fringe components 190, which radiate from the radiating edge 180 in the y dimension. It is these fringe components of $\vec{E}$ that form the signal $\mathbf{76}_1$ that the active antenna section 176 radiates.

In contrast, while the antenna section 176 is inactive and the antenna section 178 is active, the latter antenna section radiates fringe electric-field components 192, which form the signal 762 that the active antenna section 178 radiates.

Because the electric-field components 190 and 192 have opposite polarities, it is the electric fields associated with the antenna sections 176 and 178 that provide the 180° phase difference between the signal ports $\mathbf{38}_1$ and $\mathbf{38}_4$, and between the signal ports $\mathbf{38}_2$ and $\mathbf{38}_3$.

A corresponding analysis shows that during a receive mode, the antenna sections 176 and 178 also are configured to provide the 180° phase difference between the signal ports $\mathbf{38}_1$ and $\mathbf{38}_4$, and between the signal ports $\mathbf{38}_2$ and $\mathbf{38}_3$.

And the approximately $\lambda_m/4$ separation ($\lambda_m$ is the wavelength of the reference wave 36 within the intermediate region 186) between the signal ports $\mathbf{38}_1$ and $\mathbf{38}_2$, and $\mathbf{38}_3$ and $\mathbf{38}_4$, in the x dimension provides the approximately 90° phase difference between these pairs of signal ports as described above in conjunction with FIGS. 1-7.

Referring to FIGS. 13-14, operation of the antenna unit 172 is described during a transmit mode of an antenna to which the antenna unit belongs, according to an embodiment in which the reference wave 36 propagates along the transmission medium 34 in a $TE_{10}$ mode. For example, if the antenna is part of a radar subsystem, then the antenna generates one or more main radar beams.

A control circuit (not shown in FIGS. 13-14) controls a signal generator (not shown in FIGS. 13-14) to generate the reference wave 36 as a sinusoid having a suitable frequency f and wavelength λ. For example, for a radar application, the reference wave 36 may have a frequency fin an approximate range of 5 Gigahertz (GHz)-110 GHz.

Next, the control circuit (not shown in FIGS. 13-14) determines whether to activate or deactivate the antenna unit 172. For example, the control circuit may base this determination on whether the antenna unit 172 is to be active or inactive for the beam pattern that the control circuit is programmed, or otherwise controlled, to generate.

If the control circuit (not shown in FIGS. 13-14) determines that the antenna unit 172 is to be inactive, then it generates, on each of the inner conductors $\mathbf{56}_1$-$\mathbf{56}_4$ of the signal ports $\mathbf{38}_1$-$\mathbf{38}_4$, a respective control signal that causes the activation devices (e.g., diodes) $\mathbf{40}_1$-$\mathbf{40}_4$ to uncouple the inner conductors from the respective excitation points $\mathbf{42}_1$-$\mathbf{42}_4$ such that all of the inner conductors are uncoupled from all of the excitation points.

But if the control circuit (not shown in FIGS. 13-14) determines that the antenna unit 172 is to be active, then it determines which of the relative phases 0°, 90°, 180°, and 270° to impart to the signal 76 to be radiated by the antenna element 170.

Next, the control circuit (not shown in FIGS. 13-14) activates the activation device 40 associated with the relative phase that the control circuit determined to impart to the signal 76, and deactivates the other activation devices. For example, if the control circuit determined to impart the relative phase 270° to the signal 76, then the control circuit generates, on the inner conductor $\mathbf{54}_3$, a control signal having a value that activates the activation device $\mathbf{40}_3$ to couple the inner conductor $\mathbf{54}_3$ to the excitation point $\mathbf{42}_3$, and generates, on the inner conductors $\mathbf{54}_1$, $\mathbf{54}_2$, and $\mathbf{54}_4$, respective control signals having values that deactivate these activation devices to uncouple the inner conductors $\mathbf{54}_1$, $\mathbf{54}_2$, and $\mathbf{54}_4$ from the excitation points $\mathbf{42}_1$, $\mathbf{42}_2$, and $\mathbf{42}_4$, respectively.

Then, the probe 62 associated with the activated device 40 couples the reference wave 36 at the respective location 64 to the associated excitation point 42 via the activated device to excite the corresponding antenna section 176 or 178 of the antenna element 170. For example, if the control circuit (not shown in FIGS. 13-14) determined to impart the relative phase 180° to the signal 76, then the probe $\mathbf{62}_4$ couples the reference wave 36 at the location $\mathbf{64}_4$ to the excitation point $\mathbf{42}_4$ via the activated device $\mathbf{40}_4$ such that the antenna section 178 will radiate the signal 762.

Next, the excited antenna section 176 or 178 of the antenna element 170 radiates, in response to the signal at the excitation point 42 associated with the activated device 40, the signal 76 having the relative phase associated with the excitation point. For example, if the control circuit (not shown in FIGS. 13-14) activates the device $\mathbf{40}_4$, then the antenna section 178 of the antenna element 170 radiates the signal 762 having a relative phase of 270°.

The control circuit (not shown in FIGS. 13-14) repeats the above steps for one or more subsequent antenna transmit radiation patterns. For example, the control circuit may repeat the above procedure to step an antenna that includes the antenna unit 172 through a time sequence of transmit radiation patterns to steer each of one or more main transmit beams from a respective one direction to a respective other direction.

Still referring to FIGS. 13-14, operation of the antenna unit 172 is described during a receive mode of an antenna to which the antenna unit belongs, according to an embodiment. For example, if the antenna is part of a radar subsystem, then the antenna generates one or more main radar receive beams.

A control circuit (not shown in FIGS. 13-14) determines whether to activate or deactivate the antenna unit 172. For example, the control circuit may base this determination on whether the antenna unit 172 needs to be active or inactive for the receive beam pattern that the control circuit is programmed, or otherwise controlled, to generate.

If the control circuit (not shown in FIGS. 13-14) determines that the antenna unit 172 is to be inactive, then it generates, on each of the inner conductors $\mathbf{54}_1$-$\mathbf{54}_4$ of the respective signal ports $\mathbf{38}_1$-$\mathbf{38}_4$, a respective control signal that uncouples the inner conductor from the respective one of the excitation points $\mathbf{42}_1$-$\mathbf{42}_4$ such that all of the inner conductors are uncoupled from all of the excitation points.

But if the control circuit (not shown in FIGS. 13-14) determines that the antenna unit 172 is to be active, then the control circuit determines which of the relative phases 0°, 90°, 180°, and 270° to impart to the signal (not shown in FIGS. 13-14) to be received by the antenna element 170.

Next, the control circuit (not shown in FIGS. 13-14) activates the device 40 associated with the relative phase that the control circuit determined to impart to the received signal (not shown in FIGS. 13-14), and deactivates the other activation devices. For example, if the control circuit determined to impart the relative phase 90° to the received signal, then the control circuit generates, on the inner conductor $\mathbf{54}_2$, a control signal having a value that causes the device $\mathbf{40}_2$ to couple the inner conductor $\mathbf{54}_2$ to the excitation point $\mathbf{42}_2$, and generates, on the inner conductors $\mathbf{54}_1$, $\mathbf{54}_3$, and $\mathbf{54}_4$, respective control signals having values that cause the devices $\mathbf{40}_1$, $\mathbf{40}_3$, and $\mathbf{40}_4$ to uncouple the inner conductors $\mathbf{54}_1$, $\mathbf{54}_3$, and $\mathbf{54}_4$ from the excitation points $\mathbf{42}_1$, $\mathbf{42}_3$, and $\mathbf{42}_4$, respectively.

Then, the antenna element 170 couples the received signal (not shown in FIGS. 13-14) to the location 64 of the transmission medium 34 associated with the activated device 40 via the corresponding excitation point 42, the activated device, the corresponding inner conductor 54, and the corresponding probe 62, to generate the receive version of the reference wave 36 (the signals received by all of the active antenna elements 170 are combined in the transmission medium to form the receive version of the reference wave). For example, if the control circuit (not shown in FIGS. 13-14) determined to impart the relative phase 90° to the received signal, then the antenna section 176 of the antenna element 170 couples the received signal to the location $\mathbf{64}_2$ (not visible in FIGS. 13-14) via the excitation point $\mathbf{42}_2$, the activated device $\mathbf{40}_2$, the inner conductor $\mathbf{54}_2$, and the corresponding probe $\mathbf{62}_2$ (not visible I FIGS. 13-14) to generate the receive version of the reference wave 36.

Next, the control circuit (not shown in FIGS. 13-14) receives the receive version of the reference wave 36 via a port (not shown in FIGS. 13-14) of the transmission medium 34, and analyzes the reference wave. For example, if the control circuit and antenna that includes the antenna element 170 are part of a radar subsystem, then the control circuit analyzes the receive version of the reference wave to determine whether an object lies in a path of the one or more radar receive beam (not shown in FIGS. 13-14).

The control circuit (not shown in FIGS. 13-14) repeats the above steps for one or more subsequent antenna receive radiation patterns. For example, the control circuit may repeat the above procedure to step the antenna that includes the antenna unit 172 through a time sequence of receive radiation patterns so as to steer each of one or more main receive beams from a respective one direction to a respective other direction.

Still referring to FIGS. 13-14, alternate embodiments of the antenna unit 172 are contemplated. For example, embodiments described above in conjunction with FIGS. 1-12 and below in conjunction with FIGS. 15-18 may be applicable to the antenna element 170 or the antenna unit 172. Furthermore, an antenna including the antenna unit 172 can include one or more tuning structures 140 (FIGS. 10-11) and 166 (FIG. 12) to allow for selection from more than four relative phases for the radiated signal 76 and the received signal (not shown in FIGS. 13-14).

Figure 15:
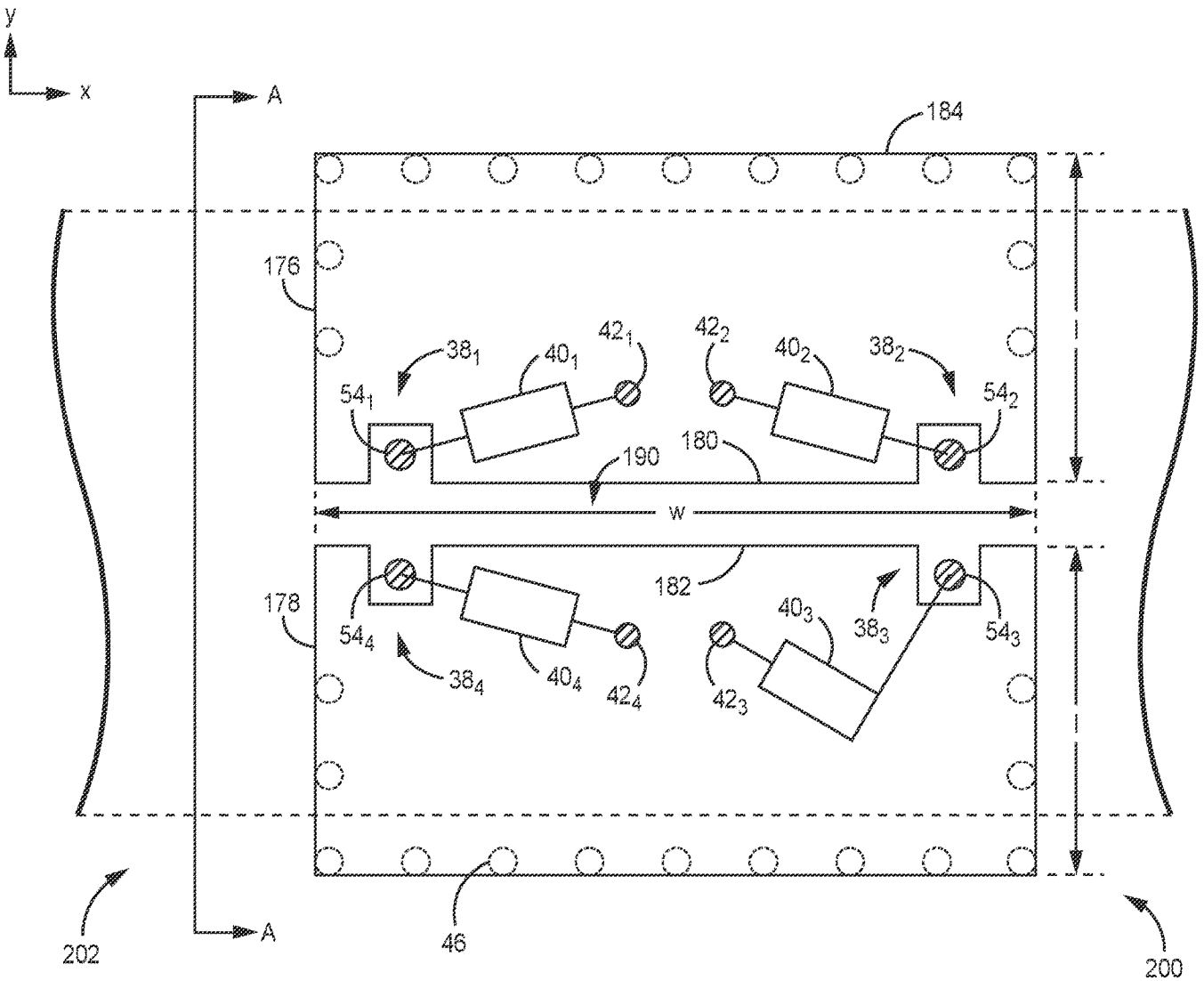
FIG. 15 is a plan view of an antenna element of an antenna unit, according to still yet another embodiment.

FIG. 15 is a plan view of an antenna element 200 of an antenna unit 202, according to an embodiment.

Figure 16:
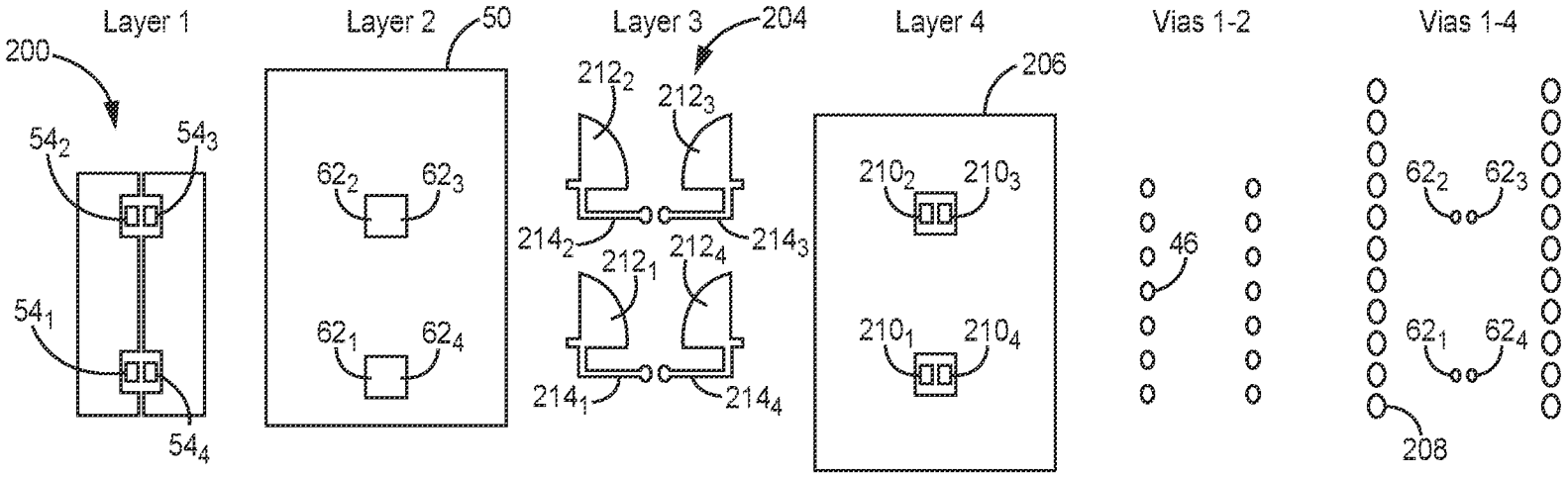
FIG. 16 is a plan view of the conductive layers of the antenna unit of FIG. 15, according to an embodiment.

FIG. 16 is a plan view of the conductive layers of the antenna unit 202, according to an embodiment.

Figure 18:
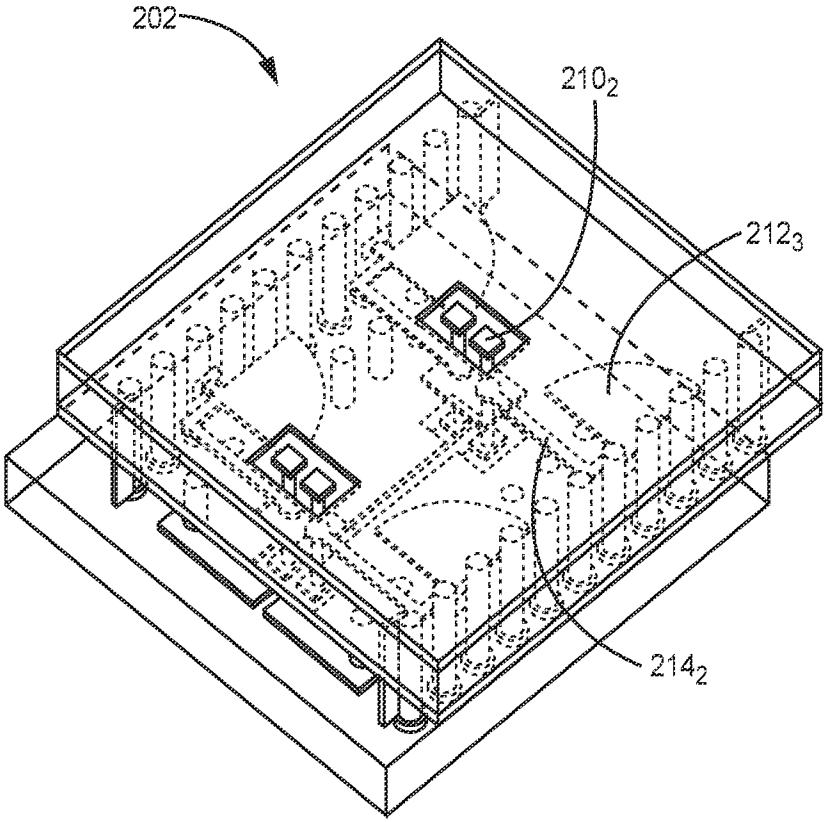
FIGS. 17-18 are respective transparency views of the antenna unit and some of the conductive layers of FIG. 16, according to an embodiment.
Figure 17:
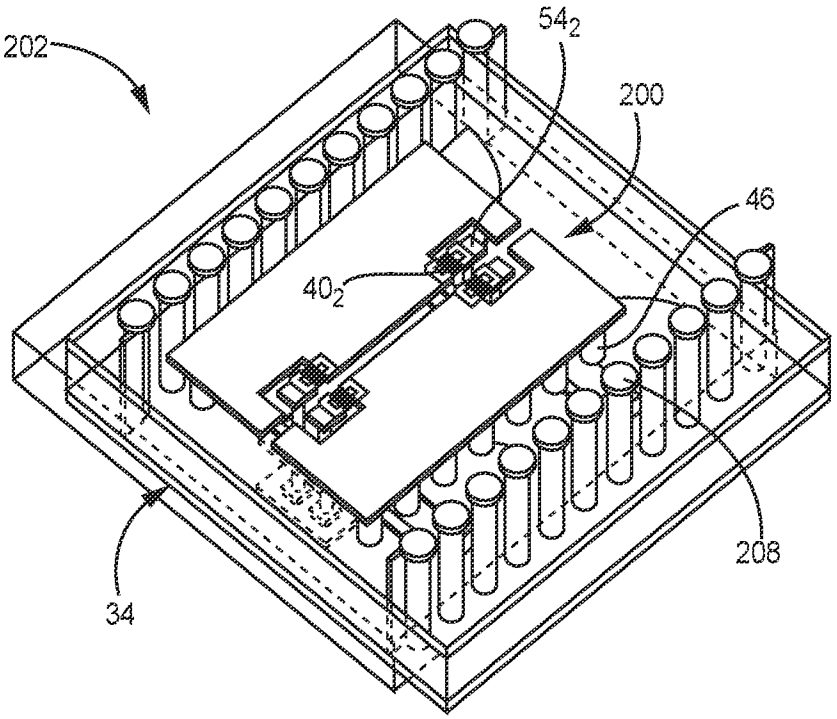

FIGS. 17-18 are respective top and bottom transparency views of the antenna unit 202 and some of the conductive layers of FIG. 16, according to an embodiment.

Referring to FIG. 15, the structure and operation of the antenna element 200 and antenna unit 202 are respectively similar to the structure and operation of the antenna element 170 and antenna unit 172 of FIG. 13 but for the change in the relative locations of the inner conductors $\mathbf{56}_1$-$\mathbf{56}_4$, the signal ports $\mathbf{38}_1$-$\mathbf{38}_4$, and the probes $\mathbf{62}_1$-$\mathbf{62}_4$ (FIG. 14) embodiment.

Referring to FIGS. 16-18, the antenna element 200 is formed in a conductive layer 1, the upper conductor 50 of the transmission medium 34 is formed in a conductive layer 2, a bypass-and-control-signal structure 204 is formed in a conductive layer 3, a lower conductor 206 of the transmission medium is formed in a conductive layer 4, conductive vias 46 are formed between the upper conductor of the transmission medium and the antenna element, and vias 208, which form walls of the transmission medium, are formed between the conductive layer 1 and the lower conductor of the transmission medium. Probe pads $\mathbf{210}_1$-$\mathbf{210}_4$ are in layer 4, and are at the opposite ends of the probes $\mathbf{62}_1$-$\mathbf{62}_4$ from the inner conductors $\mathbf{54}_1$-$\mathbf{54}_4$; the control signals (e.g., DC control signals) that select the phase of the elemental signal transmitted or received by the antenna element 170 are applied to the probe pads. And the bypass-and-control-signal structure 204 includes bypass stubs $\mathbf{212}_1$-$\mathbf{212}_4$ and bypass transmission lines $\mathbf{214}_1$-$\mathbf{214}_4$.

Referring to FIGS. 15-18, operation of the antenna unit 202 is described, according to an embodiment.

A control circuit (not shown in FIGS. 16-18) generates a control voltage, such as a DC voltage, having an active level on one of the probe pads 210 to activate the antenna unit 202 for a selected signal phase, and generates a control voltage, such as a DC voltage, having an inactive level on the remaining probe pads 210.

During a transmit or receive mode, to prevent RF energy on the probes 62 from propagating to the control circuit (not shown in FIGS. 16-18), each pair of the bypass stubs 212 and the bypass transmission lines 214 provides an RF bypass path for the RF energy on the probes 62. RF energy propagating to the control circuitry is typically undesired because such RF energy can cause the antenna unit 202, one or more of the other antenna units in the antenna, and the control circuit to malfunction or otherwise to function in an undesirable manner, and even can damage the control circuit.

For example, instead of propagating from the probe pad 2102 to the control circuitry (not shown in FIGS. 15-18), RF energy on the probe $\mathbf{62}_2$ propagates from the probe, along the bypass transmission line $\mathbf{214}_2$, to the bypass stub $\mathbf{212}_2$, and to one or both of the upper conductor 50 and lower conductor 206 of the transmission medium 34, which conductors appear as ground to RF signals at the frequency of the reference wave. The bypass stub $\mathbf{212}_2$ effectively short circuits RF signals on the stub to one or both of the RF-ground conductors 50 and 206. The transmission line $\mathbf{214}_2$ has, between the probe $\mathbf{62}_2$ and the sub $\mathbf{212}_2$, an electrical-path length of approximately $\lambda_m/4$. Consequently, the effective short circuit to RF ground at the bypass stub $\mathbf{212}_2$ appears, at the probe $\mathbf{62}_2$, as an open circuit according to well-established transmission-line theory. Therefore, the component of the reference wave on the probe $\mathbf{62}_2$ has a non-zero amplitude because the transmission line $\mathbf{214}_2$ does not load the probe, but because the component of the reference wave effectively has a short-circuit path to RF ground via the transmission line and the stub $\mathbf{212}_2$, approximately all of the energy of the component of the reference wave follows this bypass path instead of propagating to the control circuit via the probe pad $\mathbf{210}_2$.

Similarly, each pair of a bypass stub $\mathbf{212}_1$, $\mathbf{212}_3$, and $\mathbf{212}_4$ and a respective transmission line $\mathbf{214}_1$, $\mathbf{214}_3$, and $\mathbf{214}_4$ provides a similar RF bypass path for a respective probe $\mathbf{62}_1$, $\mathbf{62}_3$, and $\mathbf{62}_4$.

The antenna unit 202 otherwise operates in a manner similar to that described above in conjunction with FIGS. 13-14.

Still referring to FIGS. 15-18, alternate embodiments of the antenna unit 202 are contemplated. For example, each of one or more of the devices 40 may be a respective PIN diode. Furthermore, the bypass structure 204 may have a topology different from that described. In addition, embodiments described above in conjunction with FIGS. 1-14 and below in conjunction with FIGS. 19-22 may be applicable to the antenna element 200 or the antenna unit 202.

Figure 19:
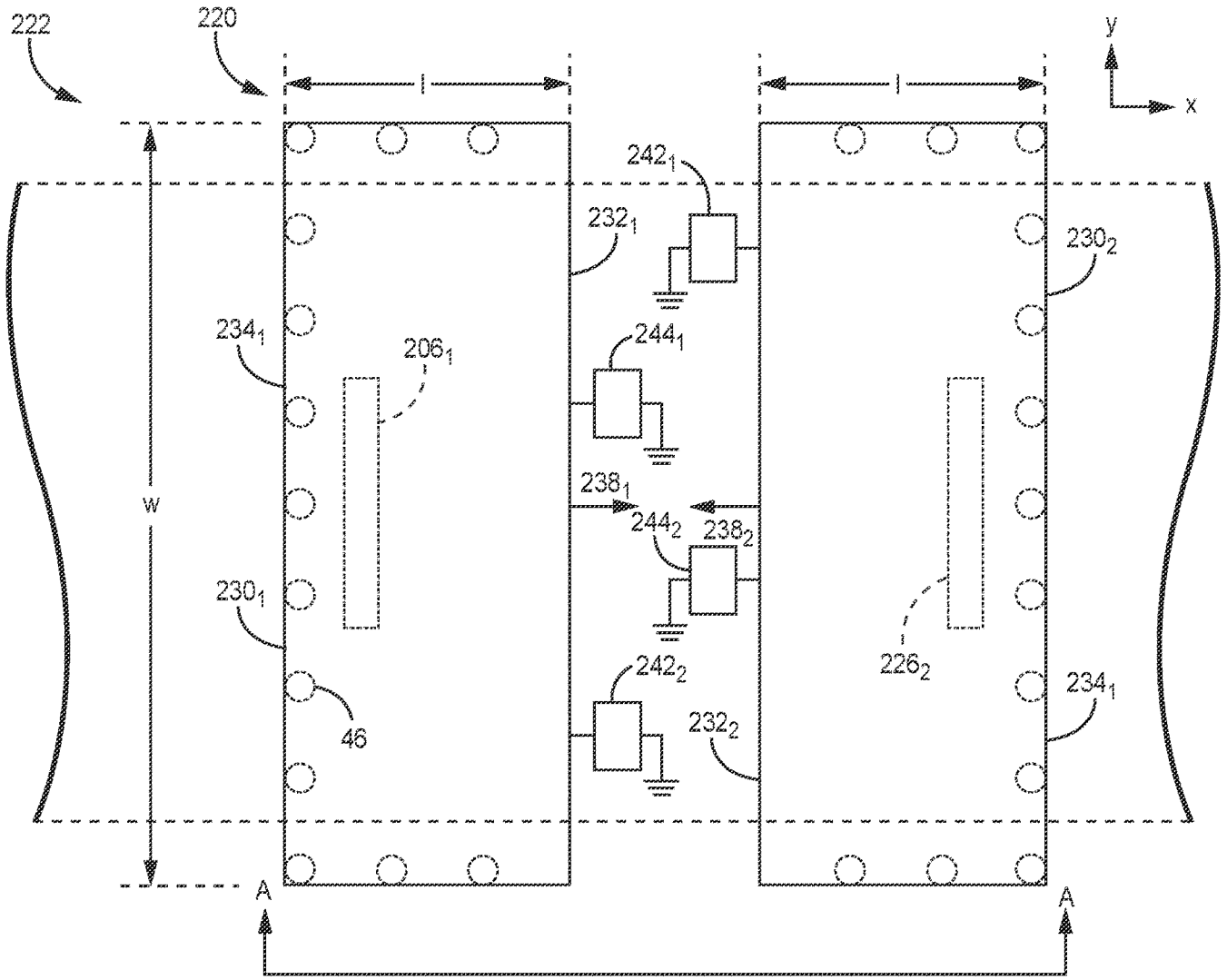
FIG. 19 is a plan view of an antenna unit of an antenna array, according to even still yet another embodiment.

FIG. 19 is a plan view of an antenna element 220 of an antenna unit 222, according to an embodiment.

Figure 20:
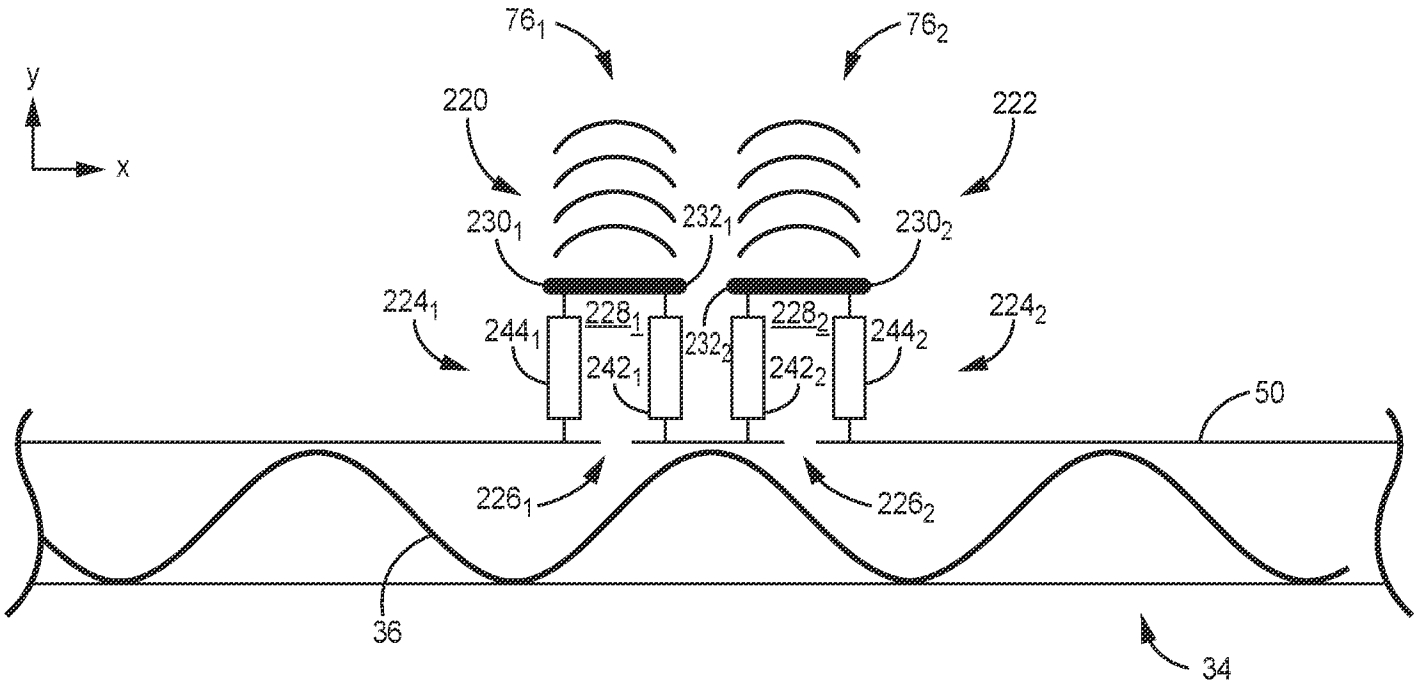
FIG. 20 is cutaway side view of the antenna unit of FIG. 19 and of a transmission medium, according to an embodiment.

FIG. 20 is a cutaway side view of the antenna unit 222 taken along lines A-A of FIG. 19, and of a transmission medium 34 disposed beneath at least a portion of the antenna unit, according to an embodiment.

Referring to FIGS. 19-20, a significant difference between the antenna unit 222 and the antenna units 32, 102, 112, 172, and 202 of FIGS. 1, 8, 9, 3, and 15 is that signal couplers $\mathbf{224}_1$ and $\mathbf{224}_2$ of the antenna unit 222 lack conductive probes such as the conductive probes 62 of FIGS. 2-7, 10-12, 4 and 16-18. That is, the signal coupling between the antenna element 220 and the transmission medium 34 is via irises $\mathbf{226}_1$ and $\mathbf{226}_2$ and intermediate regions $\mathbf{228}_1$ and $\mathbf{228}_2$ between the antenna element and the conductive upper boundary 50 of the transmission medium 34.

Similar to the antenna element 170 of FIGS. 13-14, the antenna element 220 has two sections $\mathbf{230}_1$ and $\mathbf{230}_2$, which, in an embodiment, are each planar inverting F antenna (PIFA) sections.

But unlike the antenna element 170 of FIGS. 13-14, the antenna sections $\mathbf{230}_1$ and $\mathbf{230}_2$ radiate and receive along y-dimension edges $\mathbf{232}_1$ and $\mathbf{232}_2$ instead of along x-dimension edges. Therefore, the beam-pattern envelope in the x dimension of an array including multiple antenna units 222 can have a more desirable profile (e.g., a profile having fewer, or no, nulls) as compared to the beam-pattern envelope in the x dimension of an array that includes multiple antenna elements 170.

The length l of each antenna section $\mathbf{220}_1$ and $\mathbf{220}_2$ in the in the x dimension is set to approximately $\lambda_m/4$ so that the antenna section operates in a resonant mode (l may not be set exactly to $\lambda_m/4$ so that, for example, the real part of the impedance of the antenna section has a minimum, or another particular, value that may facilitate resonant-mode operation); ($\lambda_m$ is the wavelength of the reference wave in the intermediate regions $\mathbf{228}_1$ and $\mathbf{228}_2$).

The width w of each antenna section $\mathbf{230}_1$ and $\mathbf{230}_2$ in they dimension can have any suitable value, for example, to set impedances of each antenna section as "seen" by the respective irises $\mathbf{226}_1$ and $\mathbf{226}_2$ and intermediate regions $\mathbf{228}_1$ and $\mathbf{228}_2$ to particular values that facilitate resonant operation of the antenna sections.

During a resonant transmit mode, assuming that the antenna section $\mathbf{230}_1$ is active and the antenna section $\mathbf{230}_2$ is inactive (in an embodiment, only one antenna section is active at a time), the antenna section $\mathbf{230}_1$ is excited with a signal from the iris $\mathbf{226}_1$, and, in response to this excitation signal, generates a current I that is zero at the radiating edge $\mathbf{232}_1$ and that fluctuates between $\pm I_{max}$ at an opposite, non-radiating edge $\mathbf{234}_1$, which is coupled to the conductive upper boundary 50 of the transmission medium 34 with one or more vias 46. If the transmit version of the reference wave 36 is sinusoidal, then a profile of the current I is a quarter sinusoid having, at the non-radiating edge $\mathbf{234}_1$, an amplitude that fluctuates sinusoidally between $+I_{max}$ and $-I_{max}$, and having an amplitude of zero at the radiating edge $\mathbf{232}_1$.

Further in response to the excitation signal, the active antenna section $\mathbf{230}_1$ generates, between it and the conductive upper boundary 50 of the transmission medium 34, a voltage V that is zero at the non-radiating edge $\mathbf{234}_1$ and that fluctuates between $\pm V_{max}$ at the radiating edge $\mathbf{232}_1$. If the transmit version of the reference wave 36 is sinusoidal, then the profile of the voltage V is a quarter sinusoid having, at the radiating edge $\mathbf{232}_1$, an amplitude that fluctuates sinusoidally between $+V_{max}$ and $-V_{max}$. And because the electric field is in units of V/m, the amplitude of the electric field $\vec{E}$ follows the amplitude of the voltage V.

Because the current I flowing in the active antenna section $\mathbf{230}_1$ is effectively cancelled by a current of an equal magnitude and opposite polarity flowing beneath the antenna section in the conductive boundary 50, the current I does not induce the signal $\mathbf{76}_1$ that the antenna section radiates.

Furthermore, because the voltage V is confined to the intermediate region $\mathbf{228}_1$ between the antenna section $\mathbf{230}_1$ and the boundary 50, the voltage V also does not induce the signal $\mathbf{76}_1$ that the antenna section radiates.

But the electric field $\vec{E}$ has one or more fringe components $\mathbf{238}_1$, which radiate from the radiating edge $\mathbf{232}_1$ in the x dimension. It is these fringe components $\mathbf{238}_1$ of $\vec{E}$ that form the signal $\mathbf{76}_1$ that the active antenna section $\mathbf{230}_1$ radiates.

Similarly, while the antenna section $\mathbf{230}_1$ is inactive and the antenna section $\mathbf{230}_2$ is active, the latter antenna section radiates one or more fringe electric-field components 2382, which form the signal 762 that the active antenna section $\mathbf{230}_2$ radiates.

If the irises $\mathbf{226}_1$ and $\mathbf{226}_2$ are spaced apart by, ideally, $\lambda_m/2$, then the phase difference between the transmit version of the reference wave 36 at the iris $\mathbf{226}_1$, and the transmit version of the reference wave at the iris $\mathbf{226}_2$ is, ideally, 180°.

Furthermore, because the electric-field components $\mathbf{238}_1$ and $\mathbf{238}_2$ have opposite polarities, these electric-field components provide a 180° phase difference in the signals $\mathbf{76}_1$ and $\mathbf{76}_2$ radiated by the antenna sections $\mathbf{230}_1$ and $\mathbf{230}_2$.

Therefore, the total effective phase difference between the signals $\mathbf{76}_1$ and $\mathbf{76}_2$ is ideally 180 degrees. As described in more detail below, while the antenna section $\mathbf{230}_1$ is activated (e.g., by a tuning structure such as a varactor as described below), the antenna section provides a tunable phase shift between 0° and −90° (+270°). Similarly, while the antenna section $\mathbf{230}_2$ is activated (e.g., by a tuning structure such as a varactor as described below), the antenna section provides a tunable phase shift between +90° and 180°.

A corresponding analysis shows that during a receive mode and without any tuning structures, the antenna sections $\mathbf{230}_1$ and $\mathbf{230}_2$ also are configured to provide a total effective phase difference of 180° between the signals (not shown in FIGS. 19-20) that the antenna sections radiate to the irises $\mathbf{226}_1$ and $\mathbf{226}_2$, respectively, for generation of the receive version of the reference wave 36.

So that the antenna unit 222 can provide relative phases other than 0° and 180° to the radiated signals $\mathbf{76}_1$ and $\mathbf{76}_2$, and to the signals received (not shown in FIGS. 19-20) by the antenna element 220, the antenna unit includes optional tuning structures $\mathbf{242}_1$ and $\mathbf{242}_2$, such as varactors, respectively coupled between each antenna section $\mathbf{230}_1$ and $\mathbf{230}_2$ and a reference node such as the conductive upper boundary 50 of the transmission medium 34.

And to activate and deactivate the antenna sections $\mathbf{230}_1$ and $\mathbf{230}_2$, the antenna unit 220 includes respective coupling devices $\mathbf{244}_1$ and $\mathbf{244}_2$, such as PIN diodes, respectively coupled between each antenna section $\mathbf{230}_1$ and $\mathbf{230}_2$ and the conductive boundary 50 of the transmission medium 34.

Referring to FIGS. 19-20, operation of the antenna unit 222 is described during a transmit mode of an antenna array to which the antenna unit belongs, according to an embodiment. For example, if the antenna is part of a radar subsystem, then the antenna generates one or more main transmit radar beams.

A control circuit (not shown in FIGS. 19-20) controls a signal generator (not shown in FIGS. 19-20) to generate the transmit version of the reference wave 36 as a sinusoid having a suitable frequency f and wavelength λ. For example, for a radar application, the reference wave 36 may have a frequency 5 Gigahertz (GHz)-110 GHz.

Next, the control circuit (not shown in FIGS. 19-20) determines whether to activate or deactivate the antenna unit 222. For example, the control circuit may base this determination on whether the antenna unit 222 is to be active or inactive for the beam pattern that the control circuit is programmed, or otherwise controlled, to generate.

If the control circuit (not shown in FIGS. 19-20) determines that the antenna unit 222 is to be inactive, then the control circuit generates, on each of the antenna sections $\mathbf{230}_1$ and $\mathbf{230}_2$, a respective control signal that causes the coupling devices $\mathbf{244}_1$-$\mathbf{244}_2$ to uncouple the antenna sections from the irises $\mathbf{226}_1$ and $\mathbf{226}_2$ such that neither of the antenna sections radiates a signal.

But if the control circuit (not shown in FIGS. 19-20) determines that the antenna unit 222 is to be active, then the control circuit determines what relative phase to impart to the signal 76 to be radiated by the antenna element 220.

Next, the control circuit (not shown in FIGS. 19-20) determines the relative phase of the signal 76 to be radiated.

Then, the control circuit (not shown in FIGS. 19-20) generates, on one of the antenna sections $\mathbf{230}_1$ and $\mathbf{230}_2$, a control voltage that activates the one antenna section and causes the respective tuning structure 242 to shift the phase of the respective radiated signal 76 to the determined value, and generates on the other antenna section a control signal that deactivates the other antenna section. For example, if the determined phase is 160°, then the control circuit generates, on the antenna section $\mathbf{230}_2$, a control signals that causes the coupling device $\mathbf{244}_2$ to activate the antenna section $\mathbf{230}_2$ and that causes the tuning structure $\mathbf{242}_2$ to shift the phase of the signal $\mathbf{76}_2$ by −20° to 160°, and generates, on the antenna section $\mathbf{230}_1$, a control signal that causes the coupling device $\mathbf{244}_1$ to deactivate the antenna section $\mathbf{230}_1$.

Next, the iris 226 corresponding to the active antenna section 230 couples the transmit version of the reference wave 36 to the active antenna section via the region 228 corresponding to the active antenna section. For example, if the antenna section $\mathbf{230}_2$ is the active antenna section, then the iris $\mathbf{226}_2$ couples the transmit version of the reference wave 36 to the antenna section $\mathbf{230}_2$ via the intermediate region $\mathbf{228}_2$ to excite the antenna section $\mathbf{230}_2$ of the antenna element 220.

Then, the excited antenna section 230 of the antenna element 220 radiates, in response to the signal from the iris 226 associated with the activate antenna section, the signal 76 having the relative phase associated with the active antenna section. For example, if the control circuit (not shown in FIGS. 19-20) activates the antenna section $230_2$ and controls the tuning structure $242_2$ to impart a −20° phase shift, then the antenna section $230_2$ of the antenna element 220 radiates the signal $76_2$ having a relative phase of 160°

The control circuit (not shown in FIGS. 19-20) repeats the above steps for one or more subsequent antenna transmit radiation patterns. For example, the control circuit may repeat the above procedure to step an antenna that includes the antenna unit 222 through a time sequence of transmit radiation patterns to steer each of one or more main transmit beams from a respective one direction to a respective other direction.

Still referring to FIGS. 19-20, operation of the antenna unit 222 is described during a receive mode of an antenna to which the antenna unit belongs, according to an embodiment. For example, if the antenna is part of a radar subsystem, then the antenna generates one or more main radar receive beams.

First, the control circuit (not shown in FIGS. 19-20) determines whether to activate or deactivate the antenna unit 222. For example, the control circuit may base this determination on whether the antenna unit 222 is to be active or inactive for the beam pattern that the control circuit is programmed, or otherwise controlled, to generate.

If the control circuit (not shown in FIGS. 19-20) determines that the antenna unit 222 is to be inactive, then it generates, on each of the antenna sections $230_1$ and $230_2$, a respective control signal that causes the coupling devices (e.g., diodes) $244_1$-$244_2$ to uncouple the antenna sections from the irises $226_1$ and $226_2$ such that neither of the antenna sections couples a received signal to the corresponding iris.

But if the control circuit (not shown in FIGS. 19-20) determines that the antenna unit 222 is to be active, then it determines what relative phase to impart to the signal (not shown in FIGS. 19-20) to be received by the antenna element 220.

Then, the control circuit (not shown in FIGS. 19-20) generates, on one of the antenna sections $230_1$ and $230_2$, a control signal that activates the one antenna section and causes the respective tuning structure 242 to shift the phase of the respective received signal (not shown in FIGS. 19-20) to the determined value, and generates on the other antenna section a control signal that deactivates the other antenna section. For example, if the determined phase is −10°, then the control circuit generates, on the antenna section $230_1$, a control signal that causes the coupling device $244_1$ to activate the antenna section $230_1$ and that causes the tuning structure $242_1$ to shift the phase of the signal received by the antenna section $230_1$ by −10° to −10°, and generates, on the antenna section $230_2$, a control signal that causes the coupling device $244_2$ to deactivate the antenna section $230_2$.

Next, the active antenna section 230 couples the received signal (not shown in FIGS. 19-20) to the iris 226 corresponding to the active antenna section 230 via the active region 238 corresponding to the active antenna section. For example, if the antenna section $230_1$ is the active antenna section, then the antenna section $230_1$ couples the signal that it receives to the iris 226*i* via the intermediate region $228_1$ to excite formation of the receive version of the reference wave 36 in the transmission medium 34.

Then, the control circuit (not shown in FIGS. 19-20) receives the receive version of the reference wave 36 via a port (not shown in FIGS. 19-20) of the transmission medium 34, and analyzes the receive version of the reference wave. For example, if the control circuit and antenna that includes the antenna element 200 are part of a radar subsystem, then the control circuit analyzes the receive version of the reference wave 36 to determine whether an object lies in a path of the one or more radar receive beams (not shown in FIGS. 19-20).

The control circuit (not shown in FIGS. 19-20) repeats the above steps for one or more subsequent antenna receive radiation patterns. For example, the control circuit may repeat the above procedure to step the antenna that includes the antenna unit 222 through a time sequence of receive radiation patterns to steer each of the one or more main receive beams from a respective one direction to a respective other direction.

Still referring to FIGS. 19-20, alternate embodiments of the antenna unit 222 are contemplated. For example, the coupling devices 244 can be omitted from the antenna unit 222, and the tuning structures 242 can be used both to adjust phase and to activate and to deactivate the respective antenna sections 230. Furthermore, embodiments described above in conjunction with FIGS. 1-18 and below in conjunction with FIGS. 121-22 may be applicable to the antenna element 220 or the antenna unit 222.

Figure 21:
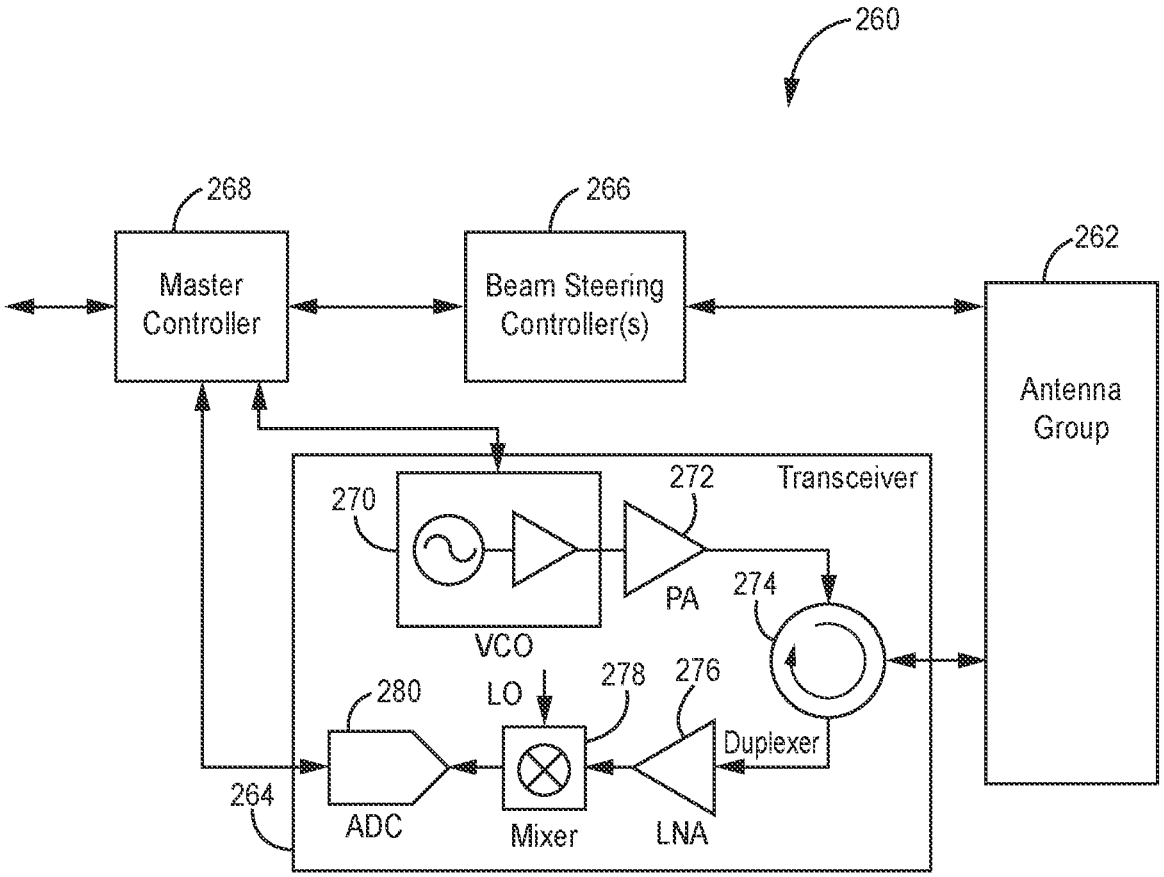
FIG. 21 is a diagram of a radar subsystem that includes at least one antenna array incorporating one or more of the antenna units and antenna-array structures of FIGS. 1-20, according to an embodiment.

FIG. 21 is a block diagram of a radar subsystem 260, which includes an antenna group 262 having one or more of antennas, such as the antennas 130, 150, and 160 described above in conjunction with FIGS. 10-12, the one or more antennas including one or more of the antenna units 32, 102, 112, 172, 202, and 222 described above in conjunction with FIGS. 1-9 and 13-19, according to an embodiment.

In addition to the antenna group 262, the radar subsystem 260 includes a transceiver 264, a beam-steering controller 266, and a master controller 268.

The transceiver 264 includes a voltage-controlled oscillator (VCO) 270, a preamplifier (PA) 272, a duplexer 274, a low-noise amplifier (LNA) 276, a mixer 278, and an analog-to-digital converter (ADC) 280. The VCO 270 is configured to generate a reference signal having a frequency $f_0=c/\lambda_0$, which is the frequency for which at least one of the antennas of the antenna group 262 is designed. The PA 272 is configured to amplify the VCO signal, and the duplexer 274 is configured to couple the reference signal to the antennas of the antenna group 262, via one or more signal feeders (not shown in FIG. 21), as transmit versions of respective reference waves. One or both of the duplexer 274 and antenna group 272 can include one or more of the signal feeders. The duplexer 274 is also configured to receive receive versions of respective reference waves from the antennas of the antenna group 262, and to provide these receive versions of the respective reference waves to the LNA 276, which is configured to amplify these received signals. The mixer 278 is configured to shift the frequencies of the amplified received signals down to a base band, and the ADC 280 is configured to convert the down-shifted analog signals to digital signals for processing by the master controller 268.

The beam-steering controller 266 is configured to steer the beams (both transmit and receive beams) generated by the one or more antennas of the antenna group 262 by generating the control signals to the control ports of the antenna units as a function of time and main-beam position. By appropriately generating the control signals, the beam-steering controller 266 is configured to selectively activate, deactivate, and generate a phase shift for, the antenna elements of the antenna units according to selected spatial and temporal patterns.

The master controller 268 is configured to control the transceiver 264 and the beam-steering controller 266, and to analyze the digital signals from the ADC 280. For example, assuming that the one or more antennas of the antenna group 262 are designed to operate at frequencies in a range centered about $f_0$, the master controller 268 is configured to adjust the frequency of the signal generated by the VCO 270 for, e.g., environmental conditions such as weather, the average number of objects in the range of the one or more antennas of the antenna assembly, and the average distance of the objects from the one or more antennas, and to conform the signal to spectrum regulations. Furthermore, the master controller 268 is configured to analyze the signals from the ADC 280 to, e.g., identify a detected object, and to determine what action, if any, that a system including, or coupled to, the radar subsystem 260 should take. For example, if the system is a self-driving vehicle or a self-directed drone, then the master controller 268 is configured to determine what action (e.g., braking, swerving), if any, the vehicle should take in response to the detected object.

Operation of the radar subsystem 260 is described below, according to an embodiment. Any of the system components, such as the master controller 268, can store in a memory, and execute, software/program instructions to perform the below-described actions. Alternatively, any of the system components, such as the system controller 268, can store, in a memory, firmware that when loaded configures one or more of the system components to perform the below-described actions. Or any of the system components, such as the system controller 268, can be hardwired to perform the below-described actions.

The master controller 268 generates a control voltage that causes the VCO 270 to generate a reference signal at a frequency within a frequency range centered about $f_0$. For example, $f_0$ can be in the range of approximately 5 Gigahertz (GHz)-110 GHz.

The VCO 270 generates the signal, and the PA 272 amplifies the signal and provides the amplified signal to the duplexer 274.

The duplexer 274 can further amplify the signal, and couples the amplified signal to the one or more antennas of the antenna group 262 as a respective transmit version of a reference wave.

While the duplexer 274 is coupling the signal to the one or more antennas of the antenna group 262, the beam-steering controller 266, in response to the master controller 268, is generating control signals to the antenna units of the one or more antennas. These control signals cause the one or more antennas to generate and to steer one or more main signal-transmission beams. The control signals cause the one or more main signal-transmission beams to have desired characteristics (e.g., phase, amplitude, polarization, direction, half-power beam width (HPBW)), and also cause the side lobes to have desired characteristics such as suitable total side-lobe power and a suitable side-lobe level (e.g., a difference between the magnitudes of a smallest main signal-transmission beam and the largest side lobe).

Then, the master controller 268 causes the VCO 270 to cease generating the reference signal.

Next, while the VCO 270 is generating no reference signal, the beam-steering controller 266, in response to the master controller 268, generates control signals to the antenna units of the one or more antennas. These control signals cause the one or more antennas to generate and to steer one or more main signal-receive beams. The control signals cause the one or more main signal-receive beams to have desired characteristics (e.g., phase, amplitude, polarization, direction, half-power beam width (HPBW)), and also cause the side lobes to have desired characteristics such as suitable total side-lobe power and a suitable side-lobe level. Furthermore, the beam-steering controller 266 can generate the same sequence of control signals for steering the one or more main signal-receive beams as it does for steering the one or more main signal-transmit beams.

Then, the duplexer 274 couples receive versions of reference waves respectively generated by the one or more antennas of the antenna subassembly 262 to the LNA 266.

Next, the LNA 272 amplifies the received signals.

Then, the mixer 278 down-converts the amplified received signals from a frequency, e.g., at or near $f_0$, to a baseband frequency.

Next, the ADC 280 converts the analog down-converted signals to digital signals.

Then, the master system controller 268 analyzes the digital signals to obtain information from the signals and to determine what, if anything, should be done in response to the information obtained from the signals.

The master system controller 268 can repeat the above cycle one or more times.

Still referring to FIG. 21, alternate embodiments of the radar subsystem 260 are contemplated. For example, the radar subsystem 260 can include one or more additional components not described above, and can omit one or more of the above-described components. Furthermore, embodiments described above in conjunction with FIGS. 1-20 and below in conjunction with FIG. 22 may apply to the radar subsystem 260.

Figure 22:
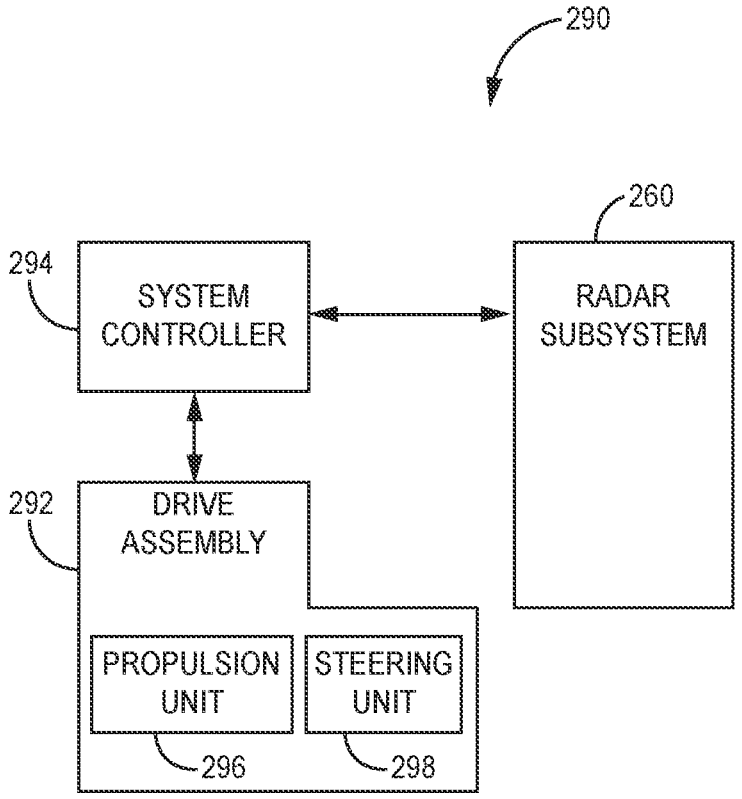
FIG. 22 is a diagram of a system that includes one or more of the radar subsystem of FIG. 21, according to an embodiment.

FIG. 22 is a block diagram of a system, such as a vehicle system 290, which includes the radar subsystem 260 of FIG. 21, according to an embodiment. For example, the vehicle system 290 can be an unmanned aerial vehicle (UAV) such as a drone, or a self-driving car.

In addition to the radar subsystem 260, the vehicle system 290 includes a drive assembly 292 and a system controller 294.

The drive assembly 292 includes a propulsion unit 296, such as an engine or motor, and includes a steering unit 298, such as a rudder, flaperon, pitch control, or yaw control (for, e.g., an UAV or drone), or a steering wheel linked to steerable wheels (for, e.g., a self-driving car).

The system controller 294 is configured to control, and to receive information from, the radar subsystem 260 and the drive assembly 292. For example, the system controller 294 can be configured to receive locations, sizes, and speeds of nearby objects from the radar subsystem 260, and to receive the speed and traveling direction of the vehicle system 290 from the drive assembly 292.

Operation of the vehicle system 290 is described below, according to an embodiment. Any of the system components, such as the system controller 294, can store in a memory, and execute, software/program instructions to perform the below-described actions. Alternatively, any of the system components, such as the system controller 294, can store, in a memory, firmware that when loaded configures one or more of the system components to perform the below-described actions. Or any of the system components, such as the system controller 294, can be circuitry hardwired to perform the below-described actions.

The system controller 294 activates the radar subsystem 260, which, as described above in conjunction with FIG. 21, provides to the system controller information regarding one or more objects in the vicinity of the vehicle system 290. For example, if the vehicle system 290 is an UAV or a drone, then the radar subsystem can provide information regarding one or more objects (e.g., birds, aircraft, and other UAVs/drones), in the flight path to the front, sides, and rear of the UAV/drone. Alternatively, if the vehicle system 290 is a self-driving car, then the radar subsystem 260 can provide information regarding one or more objects (e.g., other vehicles, debris, pedestrians, bicyclists) in the roadway or out of the roadway to the front, sides, and rear of the vehicle system.

In response to the object information from the radar subsystem 260, the system controller 294 determines what action, if any, the vehicle system 290 should take in response to the object information. Alternatively, the master controller 268 (FIG. 21) of the radar subsystem can make this determination and provide it to the system controller 294.

Next, if the system controller 294 (or master controller 268 of FIG. 21) determined that an action should be taken, then the system controller causes the drive assembly 292 to take the determined action. For example, if the system controller 294 or master controller 268 determined that a UAV system 290 is closing on an object in front of the UAV system, then the system controller 294 can control the propulsion unit 296 to reduce air speed. Or, if the system controller 294 or master controller 268 determined that an object in front of a self-driving system 290 is slowing down, then the system controller 294 can control the propulsion unit 296 to reduce engine speed and to apply a brake. Or if the system controller 294 or master controller 268 determined that evasive action is needed to avoid an object (e.g., another UAV/drone, a bird, a child who ran in front of the vehicle system) in front of the vehicle system 290, then the system controller 294 can control the propulsion unit 296 to reduce engine speed and, for a self-driving vehicle, to apply a brake, and can control the steering unit 298 to maneuver the vehicle system away from or around the object.

Still referring to FIG. 22, alternate embodiments of the vehicle system 290 are contemplated. For example, the vehicle system 290 can include one or more additional components not described above, and can omit one or more of the above-described components. Furthermore, the vehicle system 290 can be a vehicle system other than a UAV, drone, or self-driving car. Other examples of the vehicle system 290 include a watercraft, a motor cycle, a car that is not self-driving, and a spacecraft. Moreover, a system including the radar subsystem 260 can be other than a vehicle system. Furthermore, embodiments described above in conjunction with FIGS. 1-21 may apply to the vehicle system 290.

From the foregoing it will be appreciated that, although specific embodiments have been described herein for purposes of illustration, various modifications may be made without deviating from the spirit and scope of the disclosure. Furthermore, where an alternative is disclosed for a particular embodiment, this alternative may also apply to other embodiments even if not specifically stated. In addition, any described component or operation may be implemented/performed in hardware, software, firmware, or a combination of any two or more of hardware, software, and firmware. Furthermore, one or more components of a described apparatus or system may have been omitted from the description for clarity or another reason. Moreover, one or more components of a described apparatus or system that have been included in the description may be omitted from the apparatus or system.

The invention claimed is:

1. An antenna unit, comprising:

an antenna element including at least one section and signal ports each electrically isolated from each other and from each of the at least one section;

electronic devices each configured to couple a respective one of the signal ports to a respective excitation point of one of the at least one section in response to a respective control signal; and couplers each configured to couple a respective one of the signal ports to a respective location of a respective transmission medium.

2. The antenna unit of claim 1 wherein each of the at least one section of the antenna element includes a respective, approximately planar, two-dimensional conductor.

3. The antenna unit of claim 1 wherein each of at least one of the devices includes a respective diode.

4. The antenna unit of claim 1 wherein each of at least one of the devices includes a respective varactor.

5. The antenna unit of claim 1 wherein each of at least one of the couplers includes:

a respective opening in a member configured to be a boundary of the respective transmission medium, the respective opening configured to be at approximately a respective one of the locations of the respective transmission medium; and a respective probe having a first end coupled to a respective one of the signal ports and having a second end coupled to the respective opening.

6. The antenna unit of claim 1 wherein each of at least one of the couplers includes:

a respective opening in a member configured to be a boundary of the respective transmission medium, the respective opening configured to be at approximately a respective one of the locations of the respective transmission medium; and a respective probe having a first end capacitively coupled to a respective one of the signal ports and having a second end coupled to the respective opening.

7. The antenna unit of claim 1 wherein each of at least one of the couplers includes:

a respective opening in a member configured to be a boundary of the respective transmission medium, the respective opening configured to be at approximately a respective one of the locations of the respective transmission medium; and a respective probe having a first end coupled to a respective one of the signal ports and having a second end that is configured to extend into the respective transmission medium through the respective opening.

8. The antenna unit of claim 1 wherein each of at least one of the couplers includes:

a respective opening in a first member configured to be a boundary of the respective transmission medium, the respective opening configured to be at approximately a respective one of the locations of the respective transmission medium; and a respective probe having a first end coupled to a respective one of the signal ports and having a second end that is configured to extend through the respective opening, into the respective transmission medium, and into another opening in a second member configured to be another boundary of the respective transmission medium.

9. The antenna unit of claim 1 wherein each of at least one of the couplers includes:

a respective opening in a member configured to be a boundary of the respective transmission medium, the respective opening configured to be at approximately a respective one of the locations of the respective transmission medium; and a respective probe having a first end coupled to a respective one of the signal ports and having a second end that extends through the respective opening.

10. The antenna unit of claim 1 wherein the antenna element is disposed over the couplers.

11. The antenna unit of claim 1, further comprising a phase tuner configured to alter a phase of a signal at one of the antenna element and one of the respective locations of the respective transmission medium relative to a phase of a signal at the other of the antenna element and the one of the respective locations.

12. An antenna, comprising:

at least one transmission medium;

control nodes; and an array of antenna units each including a respective antenna element having at least one section and signal ports each electrically isolated from each other and from each of the at least one section, respective electronic devices each coupled to a respective one of the control nodes and each configured to couple, selectively, a respective one of the signal ports to a respective excitation point of one of the at least one section, and couplers each configured to couple a respective one of the signal ports to a respective location of a respective one of the at least one transmission medium.

13. The antenna of claim 12 wherein at least one of the at least one transmission medium includes a waveguide.

14. The antenna of claim 12 wherein the antenna element of one antenna unit is spaced from an antenna element of another antenna unit at least by a distance approximately equal to one half of a wavelength of a wave that at least one of the at least one transmission medium is configured to carry.

15. The antenna of claim 12 wherein the antenna element of one antenna unit is spaced from an antenna element of another antenna unit at least by a distance that is less than one half of a wavelength of a wave that at least one of the at least one transmission medium is configured to carry.

16. The antenna of claim 12 wherein:

at least one of the at least one transmission medium includes a respective transmission-medium signal port; and at least one component of an antenna unit associated with the at least one of the at least one transmission medium has a respective parameter that is dependent on a distance of the antenna unit from the respective transmission-medium signal port.

17. The antenna of claim 12, further comprising:

at least two transmission media;

wherein each of at least one coupler of at least one antenna unit is configured to couple a respective one of the signal ports to a respective location of a first one of the at least two transmission media; and wherein each of at least another coupler of the at least one antenna unit is configured to couple a respective other of the signal ports to a respective location of a second one of the at least two transmission media.

18. An antenna, comprising:

at least one transmission medium;

control nodes; and an array of antenna units each including an antenna element including sections;

electronic devices each coupled to a respective one of the control nodes and each configured to enable a respective one of the sections; and couplers each configured to couple a respective one of the sections to a respective location of a respective one of the at least one transmission medium.

19. A radar subsystem, comprising:

an antenna, including at least one transmission medium each configured to carry a respective transmit reference wave and a respective receive transmit wave, control nodes, and an array of antenna units each including an antenna element including sections;

electronic devices each coupled to a respective one of the control nodes and each configured to enable a respective one of the sections; and couplers each configured to couple a respective one of the sections to a respective location of a respective one of the at least one transmission medium;

a transceiver circuit configured to generate each transmit reference wave and to receive each receive reference wave;

a beam-steering controller circuit configured to generate, on the control nodes, respective control signals to cause the antenna to form, from the at least one transmission reference wave, the transmit signals, to form, from the transmit signals, a transmit beam pattern including at least one main transmit beam, to steer each of the at least one main transmit beam, to form, from the receive signals, a receive beam pattern including at least one main receive beam, to steer each of the at least one main receive beam, and to generate, in response to the at least one main receive beam, the at least one receive reference wave; and a master controller circuit configured to detect, in response to the at least one receive reference wave from the transceiver circuit, an object.

20. A method, comprising:

generating, in response to a reference wave, intermediate signals each having a different phase;

coupling one of the intermediate signals to a respective excitation point of the antenna element via a respective conductive probe; and radiating a transmit signal from the antenna element in response to the one of the intermediate signals.

21. The method of claim 20 wherein generating the intermediate signals includes tapping the reference wave at respective locations of a transmission medium along which the reference wave is propagating.

22. The method of claim 20 wherein two of the respective excitation points locations are spaced apart by approximately a quarter wavelength of the reference wave.

23. The method of claim 20 wherein radiating the transmit signal includes radiating the transmit signal from an edge of the antenna element, the edge extending approximately parallel to a dimension along which the reference wave is propagating.

24. The method of claim 20 wherein radiating the transmit signal includes radiating the transmit signal from an edge of the antenna element, the edge extending approximately orthogonal to a dimension along which the reference wave is propagating.

25. The method of claim 20, further comprising:

generating, in response to the transmit signal, at least one main transmit beam; and steering each of the at least one main transmit beam by coupling another one of the intermediate signals to a respective location of the antenna element.

26. A method, comprising:

receiving a receive signal with an antenna element;

generating, at respective locations of the antenna element in response to the receive signal, respective intermediate signals each having a different phase; and generating a reference wave in response to one of the intermediate signals.

27. The method of claim 26 wherein generating the reference wave includes coupling the one of the intermediate signals to a respective location of a transmission medium along which the reference wave is propagating.

28. The method of claim 26 wherein two of the respective locations are spaced apart by approximately a quarter wavelength of the receive signal.

29. The method of claim 26 wherein receiving the receive signal includes exciting the antenna element along an edge of the antenna element, the edge extending approximately parallel to a dimension along which the reference wave is propagating.

30. The method of claim 26 wherein receiving the receive signal includes exciting the antenna element with the receive signal along an edge of the antenna element, the edge extending approximately orthogonal to a dimension along which the reference wave is propagating.

31. The method of claim 26, further comprising:

generating, in response to the receive signal, at least one main receive beam; and steering each of the at least one main receive beam by generating the reference wave from another one of the intermediate signals.

* * * * *